US009113530B2

(12) United States Patent
Yagi et al.

(10) Patent No.: US 9,113,530 B2
(45) Date of Patent: Aug. 18, 2015

(54) LIGHTING DEVICE, ILLUMINATION DEVICE, ILLUMINATION APPARATUS AND ILLUMINATION SYSTEM

(71) Applicant: Panasonic Corporation, Osaka (JP)

(72) Inventors: Sana Yagi, Osaka (JP); Kenichi Fukuda, Osaka (JP); Masahiro Naruo, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/500,112

(22) Filed: Sep. 29, 2014

(65) Prior Publication Data

US 2015/0091464 A1 Apr. 2, 2015

(30) Foreign Application Priority Data

Oct. 1, 2013 (JP) ..... 2013-206583
May 9, 2014 (JP) ..... 2014-098025

(51) Int. Cl.
*H05B 37/02* (2006.01)
*H05B 33/08* (2006.01)

(52) U.S. Cl.
CPC ..... *H05B 33/0851* (2013.01); *H05B 33/0809* (2013.01); *H05B 33/0866* (2013.01)

(58) Field of Classification Search
CPC .... H05B 37/02; H05B 33/08; H05B 33/0815; H05B 33/0833; H05B 33/0845; H05B 33/0851; H05B 33/0866; H05B 33/0809
USPC ..... 315/200 R, 209 R, 291, 297, 299, 307, 315/308
See application file for complete search history.

(56) References Cited

U.S. PATENT DOCUMENTS

| | | | | |
|---|---|---|---|---|
| 8,816,597 | B2 * | 8/2014 | Suzuki | 315/291 |
| 2010/0225241 | A1 * | 9/2010 | Maehara et al. | 315/250 |
| 2012/0068617 | A1 | 3/2012 | Matsuda et al. | |
| 2012/0153836 | A1 | 6/2012 | Shimizu | |
| 2013/0119879 | A1 | 5/2013 | Kitamura et al. | |
| 2013/0241428 | A1 | 9/2013 | Takeda | |

FOREIGN PATENT DOCUMENTS

| | | |
|---|---|---|
| JP | 2004-111104 | 4/2004 |
| JP | 2012-43657 | 3/2012 |
| JP | 2012-69308 | 4/2012 |
| JP | 2012-134001 | 7/2012 |
| JP | 2012-142134 | 7/2012 |

(Continued)

*Primary Examiner* — Jimmy Vu
(74) *Attorney, Agent, or Firm* — Renner, Otto, Boisselle & Sklar, LLP

(57) ABSTRACT

A lighting device includes an AC to DC conversion unit for receiving a setting signal and converting it into a DC voltage having a predetermined voltage, voltage conversion units for converting the DC voltage inputted from the AC to DC conversion unit and driving the light source modules according to drive signals, a PWM signal generating unit for generating a PWM signal having a duty ratio corresponding to the setting signal, and a control unit, by outputting the drive signals to the voltage conversion units based on a command value determined according to the duty ratio, for controlling output powers of the voltage conversion units such that a characteristic curve of the sum of the output powers of the voltage conversion units has the maximum or at least one inflection point within an adjustment range of the conduction angle.

20 Claims, 16 Drawing Sheets

(56) References Cited

FOREIGN PATENT DOCUMENTS

| | | |
|---|---|---|
| JP | 2012-221991 | 11/2012 |
| JP | 2013-12459 | 1/2013 |
| JP | 2013-106373 | 5/2013 |
| JP | 2013-168382 | 8/2013 |
| JP | 2013-247720 | 12/2013 |

* cited by examiner

LIGHTING DEVICE, ILLUMINATION DEVICE, ILLUMINATION APPARATUS AND ILLUMINATION SYSTEM

CROSS-REFERENCE TO RELATED APPLICATION

This application claims priority to Japanese Patent Application Nos. 2013-206583 and 2014-098025 filed on Oct. 1, 2013 and May 9, 2014, respectively, the entire contents of which are incorporated herein by reference.

TECHNICAL FIELD

The present disclosure relates to a lighting device, an illumination device, an illumination apparatus and an illumination system, and more particularly to a lighting device, an illumination device, an illumination apparatus and an illumination system capable of adjusting a color temperature or light quantity.

BACKGROUND ART

Conventionally, there has been proposed a lighting device including a power supply unit to adjust a color and a quantity of illumination light by adjusting the light quantity of each of a plurality of light emitting elements with different emission colors according to a dimming signal inputted from a controller (see, e.g., Japanese Unexamined Patent Application Publication No. 2013-168382).

The power supply unit described in Japanese Unexamined Patent Application Publication No. 2013-168382 is connected to an AC power source and supplied with a power through two wires. Further, the power supply unit is connected to the controller through two other wires. The controller outputs a control signal to the power supply unit in response to the operation of an operating unit provided rotatably. According to the control signal inputted from the controller, the power supply unit controls the light quantity of the respective light emitting elements to adjust the color and the quantity of the output light.

In the lighting device described in Japanese Unexamined Patent Application Publication No. 2013-168382, a total of four wires including the two wires for connection to the AC power source and the two wires for connection to the controller are connected to the power supply unit.

Meanwhile, in the existing houses or facilities, in a case where a phase control type dimmer is installed to dim an incandescent lamp, the dimmer and the incandescent lamp are connected to each other through two wires. If the above-mentioned lighting device and light emitting diodes are used instead of the dimmer and the incandescent lamp, it is necessary to install two wires for the dimming signal in addition to the two wires for connecting the phase control type dimmer to the incandescent lamp. If it is intended to install additional wires in the existing houses or facilities, it is necessary to pass the wires through the back side of the wall, and it may take time and effort to perform the wiring work.

SUMMARY OF THE INVENTION

In view of the above, the present disclosure provides a lighting device, an illumination device, an illumination apparatus and an illumination system capable of simplifying construction work.

In accordance with a first aspect of the disclosure, there is provided a lighting device for lighting a plurality of light source modules based on a conduction angle of a setting signal inputted from a setting unit, the setting unit outputting the setting signal generated by adjusting the conduction angle of an AC voltage inputted from an AC power source, each of the light source modules including solid-state light emitting elements. The lighting device includes an AC to DC conversion unit, voltage conversion units, a PWM signal generating unit and a control unit. The AC to DC conversion unit receives the setting signal and converts the setting signal into a DC voltage having a predetermined voltage value by rectifying and smoothing the setting signal. The voltage conversion units convert a voltage level of the DC voltage inputted from the AC to DC conversion unit, and drive the light source modules according to drive signals. The PWM signal generating unit receives the setting signal, and generates a PWM signal having a duty ratio corresponding to a magnitude of the conduction angle of the setting signal. The control unit outputs the drive signals to the voltage conversion units based on a command value determined according to the duty ratio of the PWM signal. Further, the control unit controls output powers of the voltage conversion units such that a characteristic curve of the sum of the output powers of the voltage conversion units has the maximum or at least one inflection point between an upper limit and a lower limit of an adjustment range of the conduction angle.

In accordance with a second aspect of the disclosure, there is provided a lighting device for lighting a plurality of light source modules based on a setting signal of a conduction angle inputted from a setting unit, the setting unit outputting the setting signal generated by adjusting the conduction angle of an AC voltage inputted from an AC power source. The lighting device includes an AC to DC conversion unit, voltage conversion units, a PWM signal generating unit and a control unit. The AC to DC conversion unit receives the setting signal and converts the setting signal into a DC voltage having a predetermined voltage value by rectifying and smoothing the setting signal. The voltage conversion units convert a voltage level of the DC voltage outputted from the AC to DC conversion unit and drive the light source modules according to drive signals. The PWM signal generating unit receives the setting signal and generate a PWM signal having a duty ratio corresponding to a magnitude of the conduction angle of the setting signal. The control unit outputs the drive signals to the voltage conversion units based on a command value determined according to the duty ratio of the PWM signal. Further, the light source modules have solid-state light emitting elements different in emission color from each other, and include a first light source module having a relatively low color temperature and a second light source module having a relatively high color temperature, and the control unit controls output powers of the voltage conversion units such that an output curve of a current flowing through the first light source module has the maximum or an inflection point, and a current flowing through the second light source module gradually increases as the conduction angle increases, between an upper limit and a lower limit of an adjustment range of the conduction angle.

In accordance with a third aspect of the disclosure, there is provided an illumination device including the above described lighting device and an illumination load including the light source modules which are turned on and off by the lighting device.

In accordance with a fourth aspect of the disclosure, there is provided an illumination apparatus including the above described illumination device and an apparatus main body to which the illumination load is attached.

In accordance with a fifth aspect of the disclosure, there is provided an illumination system including the above described illumination apparatus and the setting unit including an operating unit. The setting unit generates the setting signal by adjusting the conduction angle of the AC voltage inputted from the AC power source according to an operation of the operating unit and outputs the setting signal to the illumination apparatus.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Hereinafter, embodiments will be described in detail with reference to the accompanying drawings.

First Embodiment

A lighting device according to a first embodiment, and an illumination device, an illumination apparatus and an illumination system using the same will be described with reference to FIGS. 1 to 7.

Figure 1:
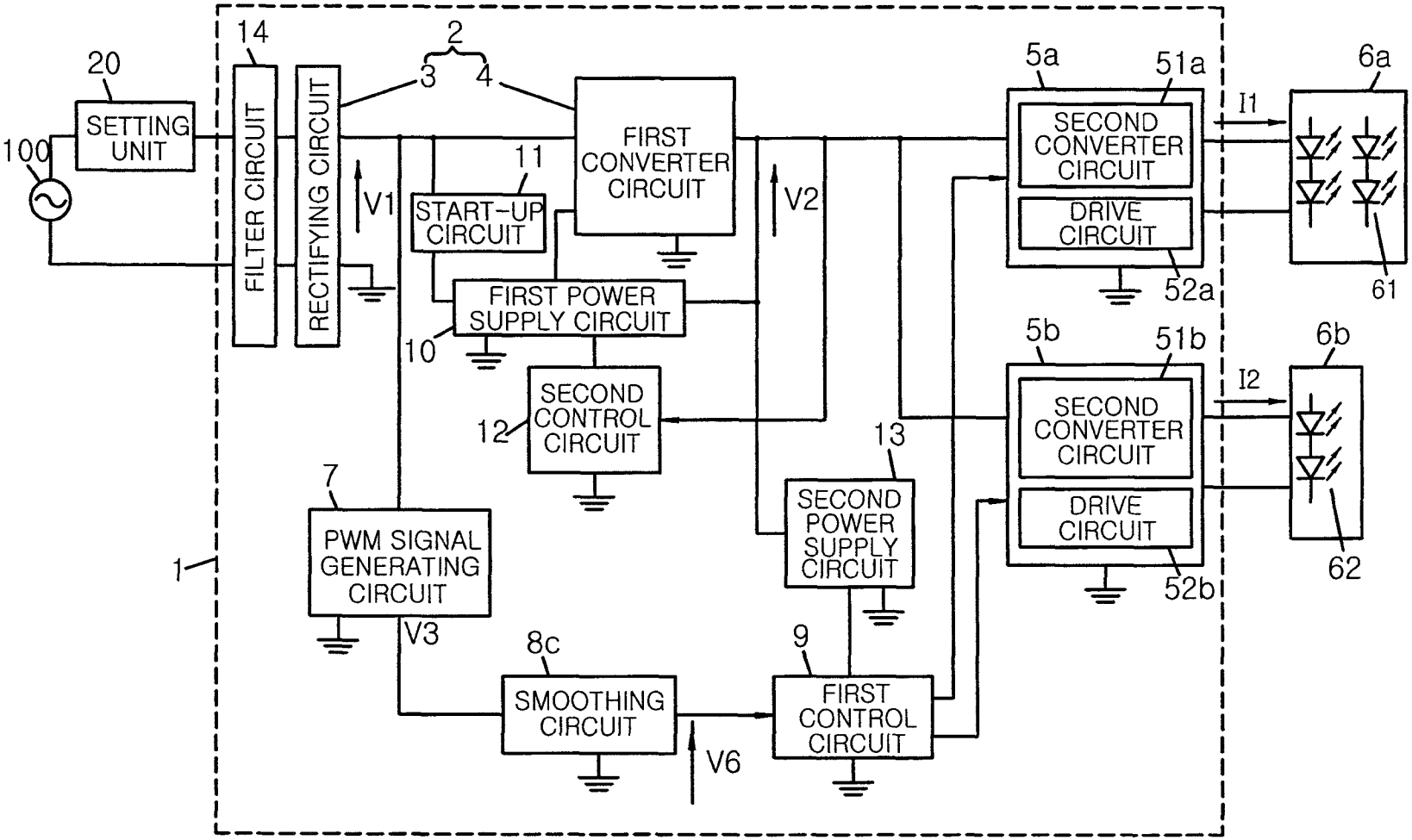
FIG. 1 is a schematic block circuit diagram of a lighting device in accordance with an embodiment.

A lighting device 1 of the present embodiment includes, as shown in FIG. 1, an AC to DC conversion unit 2, second converter circuits 51*a* and 51*b*, a PWM signal generating circuit 7, a smoothing circuit 8*c*, and a first control circuit 9.

The lighting device 1 of the present embodiment further includes a first power supply circuit 10, a start-up circuit 11, a second control circuit 12, a second power supply circuit 13, a filter circuit 14, and drive circuits 52*a* and 52*b*. The lighting device 1 turns on light source modules 6*a* and 6*b*.

An AC power source 100 of AC 100V is connected to the input side of the filter circuit 14 through a setting unit 20. A rectifying circuit 3 is connected to the output side of the filter circuit 14.

The lighting device 1 of the present embodiment turns on two types of the light source modules 6*a* and 6*b*.

The light source module 6*a* includes a plurality of light emitting diodes 61, each emitting warm color light (e.g., light having a color temperature of about 2000K). The light emitting diodes 61 are connected in series or in parallel.

The light source module 6*b* includes a plurality of light emitting diodes 62, each emitting cool color light (e.g., light having a color temperature of about 8000K). The light emitting diodes 62 are connected in series or in parallel.

In the present embodiment, the light emitting diodes 61 constituting the light source module 6*a* and the light emitting diodes 62 constituting the light source module 6*b* are mounted on the same substrate, and the substrate is incorporated in a unit to be modularized. Alternatively, the light emitting diodes 61 may be modularized as the light source module 6*a* by being incorporated into a case (not shown), and the light emitting diodes 62 may be modularized as the light source module 6*b* by being incorporated into another case (not shown).

In the present embodiment, color temperature of the light irradiated from the light source module 6*a* is different from that of the light irradiated from the light source module 6*b*. The warm color light irradiated from the light source module 6*a*, which has a relatively low color temperature, is mixed with the cool color light irradiated from the light source module 6*b*, which has a relatively high color temperature, and the mixed color light is irradiated. The light source modules 6*a* and the light source module 6*b* include solid-state light emitting elements having different emission colors from each other. Alternatively, they may include light sources configured to have different color temperatures by overlaying phosphors on solid-state light emitting elements having the same emission color. In the present embodiment, the light source modules 6*a* and 6*b* include light emitting diodes, but may include solid-state light emitting elements such as organic electroluminescence (EL) or inorganic EL elements.

The setting unit 20 is used for a user to set the color temperature and the quantity of the light (mixed color light) obtained by mixing the light irradiated from the light source module 6*a* and the light irradiated from the light source module 6*b*. The setting unit 20 includes a switching element (not shown) such as a thyristor connected in series to the AC power source 100, and a setting knob (not shown) for the user to set a phase angle at which the switching element turns on every half cycle of an AC power supply voltage.

The setting unit 20 turns the switching element on at the phase angle set by the setting knob every half cycle of the AC power supply voltage, and maintains the turning-on state of the switching element until the next zero cross of the AC power supply voltage, thereby supplying power to the lighting device 1 from the AC power source 100. Since power is not supplied to the lighting device 1 from the AC power source 100 until it reaches the phase angle set by the setting knob from the zero cross of the AC power supply voltage, an AC voltage obtained by clipping a portion of a sinusoidal waveform is generated. Thus, a setting signal generated by adjusting a conduction angle of the AC power supply voltage inputted to the lighting device 1 from the AC power source 100 is outputted to the lighting device 1 from the setting unit 20.

Figure 2:
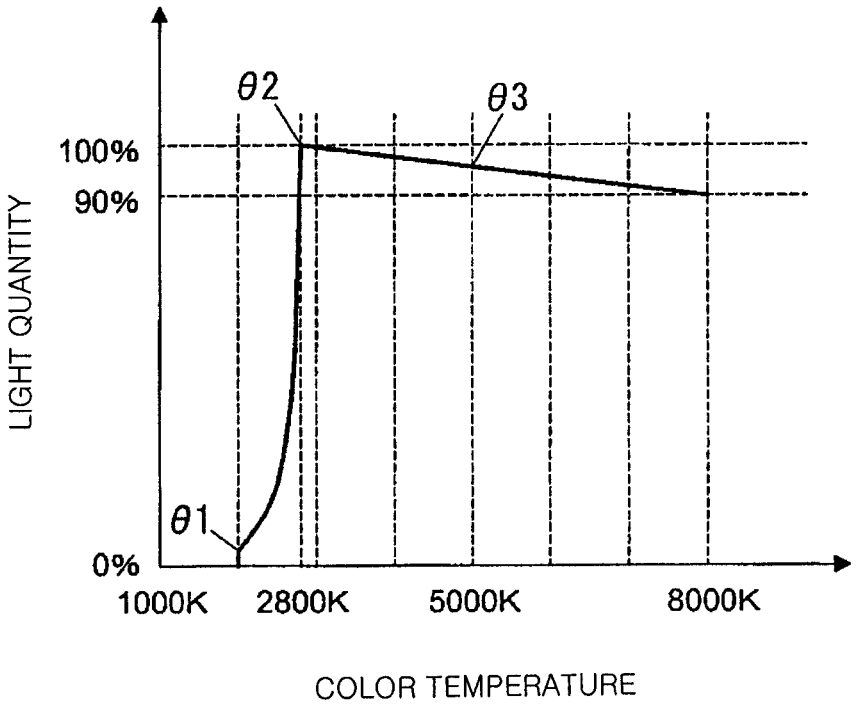
FIG. 2 is a diagram for explaining toning and dimming characteristics of the lighting device of the embodiment.

In the lighting device 1 of the present embodiment, the color temperature and the quantity of the mixed color light are changed according to the conduction angle of the setting signal, and toning and dimming are performed according to a toning-dimming curve as shown in FIG. 2. If the conduction angle of the setting signal is a minimum value θ1, the light source modules 6*a* and 6*b* are turned on at a lower limit of dimming. Further, when the conduction angle of the setting signal is the minimum value θ1, the light source modules 6*a* and 6*b* may be turned off.

While the conduction angle of the setting signal ranges from the minimum value θ1 to θ2, the toning and the dimming are performed in accordance with an increase or a decrease in the conduction angle. If the conduction angle is θ2, the mixed color light becomes light (warm white light) having a color temperature of 2800K. If the conduction angle is a maximum value θ3, the mixed color light becomes light (cool white light) having a color temperature of 5000K. Further, the conduction angle means a range of the phase angle at which the switching element included in the setting unit 20 is turned on.

The AC to DC conversion unit 2 rectifies and smoothes the setting signal inputted from the setting unit 20, thereby converting it into a DC voltage of a predetermined voltage value. The AC to DC conversion unit 2 of the present embodiment includes the rectifying circuit 3 for full-wave rectifying the AC voltage of the setting signal inputted from the setting unit 20, and a first converter circuit 4 for smoothing an output of the rectifying circuit 3.

The rectifying circuit 3 includes, e.g., a diode bridge circuit. The rectifying circuit 3 full-wave rectifies the AC voltage (setting signal) inputted from the setting unit 20 through the filter circuit 14, and outputs the full-wave rectified AC voltage.

The first converter circuit 4 includes, e.g., a switching power supply such as a flyback converter. The first converter circuit 4 converts a voltage V1 outputted from the rectifying circuit 3 into a DC voltage V2 of a predetermined voltage value by turning on and off a switching element (not shown). Further, the first converter circuit 4 may directly control currents flowing through the light source modules 6*a* and 6*b*.

The output voltage V2 from the first converter circuit 4 is fed back to the second control circuit 12. The second control circuit 12 controls the turning-on and the turning-off of the switching element (not shown) included in the first converter circuit 4 such that the output voltage V2 which is fed back is equal to a preset voltage value. The power required for operation is supplied to the second control circuit 12 from the first power supply circuit 10.

A DC voltage is supplied to the first power supply circuit 10 from a primary side or a secondary side of the first converter circuit 4 including a flyback converter. The first power supply circuit 10 converts the DC voltage supplied from the first converter circuit 4 into a DC voltage with a constant voltage level, and outputs the converted DC voltage to the second control circuit 12.

The start-up circuit 11 starts the first power supply circuit 10 to start a voltage conversion operation, for example, when the voltage signal V1 outputted from the rectifying circuit 3 exceeds a certain level.

Each of the second converter circuits 51*a* and 51*b* (voltage conversion unit) includes a switching power supply (e.g., a forward converter or a back converter). The second converter circuits 51*a* and 51*b* are connected in parallel to an output terminal of the first converter circuit 4. The light source module 6*a* is connected to an output terminal of the second converter circuit 51*a*, and the light source module 6*b* is connected to an output terminal of the second converter circuit 51*b*.

A lighting circuit 5*a* includes the second converter circuit 51*a* and the drive circuit 52*a* for driving a switching element (not shown) included in the second converter circuit 51*a* to turn on the light source module 6*a*. The drive circuit 52*a* controls the output of the second converter circuit 51*a* by turning on and off the switching element in response to a drive signal inputted from the first control circuit 9 such that an output current corresponding to the drive signal flows from the second converter circuit 51*a* to the light source module 6*a*.

Further, a lighting circuit 5*b* includes the second converter circuit 51*b* and the drive circuit 52*b* for driving a switching element (not shown) included in the second converter circuit 51*b* to turn on the light source module 6*b*. The drive circuit 52*b* controls the output of the second converter circuit 51*b* by turning on and off the switching element in response to a drive signal inputted from the first control circuit 9 such that an output current corresponding to the drive signal flows from the second converter circuit 51*b* to the light source module 6*b*.

The first control circuit 9 includes, e.g., a microcomputer (such as RL78/I1A made by Renesas Electronics Co., Ltd.). The first control circuit 9 controls the power supplied to each of the light source modules 6*a* and 6*b* by controlling the turning-on and the turning-off of the switching element included in each of the second converter circuits 51*a* and 51*b* in response to the setting signal inputted to the lighting device 1 from the setting unit 20. The power required for operation is supplied to the first control circuit 9 from the second power supply circuit 13.

The setting signal inputted to the lighting device 1 from the setting unit 20 is full-wave rectified by the rectifying circuit 3 and then inputted to the PWM signal generating circuit 7.

The PWM signal generating circuit 7 (PWM signal generating unit, a first signal generating unit) compares the voltage signal V1 with a predetermined reference value. The reference value is used for detecting whether the voltage signal V1 is zero or not, and is set to a predetermined voltage value slightly larger than a noise level. The PWM signal generating circuit 7 changes its output voltage level from L level to H level when the voltage signal V1 exceeds the reference value and changes its output voltage level from H level to L level when the voltage signal V1 becomes the reference value or less.

Thus, a PWM signal V3 outputted from the PWM signal generating circuit 7 is set to the H level within a range of the phase angle (conduction angle) at which the switching element of the setting unit 20 is conducting, and is set to the L level within a range of the phase angle (non-conduction angle) at which the switching element of the setting unit 20 is not conducting. Therefore, the PWM signal generating circuit 7 outputs the PWM signal V3 of a duty ratio corresponding to the conduction angle of the setting signal inputted from the setting unit 20.

The PWM signal V3 outputted from the PWM signal generating circuit 7 is inputted to the smoothing circuit 8*c* (smoothing unit, a second signal generating unit).

The smoothing circuit 8*c* includes a RC integration circuit (not shown) having, e.g., a resistor and a capacitor connected in series between the ground and the output terminal of the PWM signal generating circuit 7. A voltage obtained by smoothing the PWM signal V3 is generated across the capacitor. Thus, the smoothing circuit 8*c* generates a DC voltage V6 of a voltage value corresponding to the duty ratio of the PWM signal V3, and outputs the DC voltage V6 to the first control circuit 9.

The first control circuit 9 includes an analog to digital conversion unit (not shown) to digitally convert the analog output voltage V6 of the smoothing circuit 8*c* and acquire the digital output voltage. The first control circuit 9 acquires a command value of the setting signal by analog to digital converting the output voltage V6 at a predetermined timing. Further, although the DC voltage V6 obtained by smoothing the PWM signal V3 is inputted to the first control circuit 9 in the present embodiment, the first control circuit 9 may directly read the duty ratio of the PWM signal V3 from a memory (not shown).

A correspondence table defining a relationship between the setting signal obtained by analog to digital converting the output voltage V6 and the duty ratio of the drive signals (i.e., PWM signals) to be respectively outputted to the drive circuits 52*a* and 52*b* is stored in the memory by the first control circuit 9 in advance.

The first control circuit 9 determines the duty ratios of the drive signals to be respectively outputted to the drive circuits 52*a* and 52*b* based on the setting signal obtained by digitally converting the output voltage V6 from the correspondence table, and outputs the drive signals of the determined duty ratios to the drive circuits 52*a* and 52*b*. The drive circuit 52*a* drives the switching element of the second converter circuit 51*a* according to the drive signal inputted from the first control circuit 9. The drive circuit 52*b* drives the switching element of the second converter circuit 51*b* according to the drive signal inputted from the first control circuit 9.

Thus, the outputs of the second converter circuits 51*a* and 51*b* are controlled individually to change the light outputs of the light source modules 6*a* and 6*b*. In the present embodiment, the output light in accordance with the toning-dimming curve as shown in FIG. 2 is irradiated by individually changing the light outputs of the light source modules 6*a* and 6*b* having different color temperatures in emission color, and mixing the output lights of the light source modules 6*a* and 6*b*. Further, in the toning-dimming curve as shown in FIG. 2, the toning-dimming curve in the range of 0% to 90% in light quantity is set to be consistent with a dimming curve in the case of an incandescent lamp.

The operation of the lighting device 1 will be described.

The setting unit 20 generates an AC voltage in which a portion of a sinusoidal waveform is clipped by turning on the switching element connected in series to the AC power source 100 at an arbitrary phase angle set by the setting knob every half cycle of the AC power supply voltage, and outputs the generated AC voltage to the lighting device 1.

In the lighting device 1, the rectifying circuit 3 full-wave rectifies the AC voltage inputted from the setting unit 20, and the first converter circuit 4 outputs the DC voltage V2 obtained by smoothing the rectified output voltage V1 of the rectifying circuit 3 to the second converter circuits 51*a* and 51*b*.

Further, the PWM signal generating circuit 7 generates a PWM signal having a duty ratio corresponding to the conduction angle of the setting signal inputted from the setting unit 20 by comparing the output voltage V1 of the rectifying circuit 3 with a predetermined reference value. The PWM signal V3 outputted from the PWM signal generating circuit 7 is smoothed by the smoothing circuit 8*c*, and the output voltage V6 of the smoothing circuit 8*c* is inputted to the first control circuit 9. Based on the output voltage V6 of the smoothing circuit 8*c*, the first control circuit 9 determines the duty ratios of the drive signals to be respectively outputted to the drive circuits 52*a* and 52*b* by referring to the correspondence table stored in advance in the memory.

Then, the first control circuit 9 controls the outputs of the second converter circuits 51*a* and 51*b* by outputting the drive signals to the drive circuits 52*a* and 52*b*, respectively. Thus, the first control circuit 9 turns on the light source modules 6*a* and 6*b* by supplying a desired current to each of the light source modules 6*a* and 6*b*. Alternatively, the first control circuit 9 may directly read the duty ratio of the PWM signal V3 from the memory, and determine duty ratios (command value) of the drive signals to be respectively outputted to the drive circuits 52*a* and 52*b* according to the duty ratio. In this case, the smoothing circuit 8*c* becomes unnecessary.

Next, toning and dimming operation of the lighting device 1 for the light source modules 6*a* and 6*b* will be described. Generally, when performing the toning, bulb colored light and daytime white light are recommended as illumination light for illuminating an entire illumination space. In both the bulb colored illumination and the daytime white illumination, a predetermined light output is required to illuminate the illumination space with sufficient brightness. If it is desired to obtain substantially the same brightness in the bulb colored illumination and the daytime white illumination, since it feels darker in the bulb colored illumination than the daytime white illumination, it is necessary to flow a higher current in the bulb colored illumination than the daytime white illumination.

Further, while the dimming level is being lowered to the dimming lower limit, it preferable to perform dimming by using the bulb colored light. Further, in "Classification of Fluorescent Lamps and LEDs by Light Source Color and Color Rendering" of JIS Z 9112, chromaticity ranges of the bulb color and the daytime white that are light source colors of LEDs are defined in an xy chromaticity diagram. The correlated color temperature of the bulb color ranges from 2600 K to 3250 K and the correlated color temperature of the daytime white ranges from 4600 K to 5500 K. In the present embodiment, the color temperature of the light emitted by the light source module 6*a* is lower than that of bulb color, and the color temperature of the light emitted by the light source module 6*b* is higher than that of daytime white. Thus, by adjusting a mixing ratio thereof, bulb colored or daytime white emission light is obtained.

Figure 3:
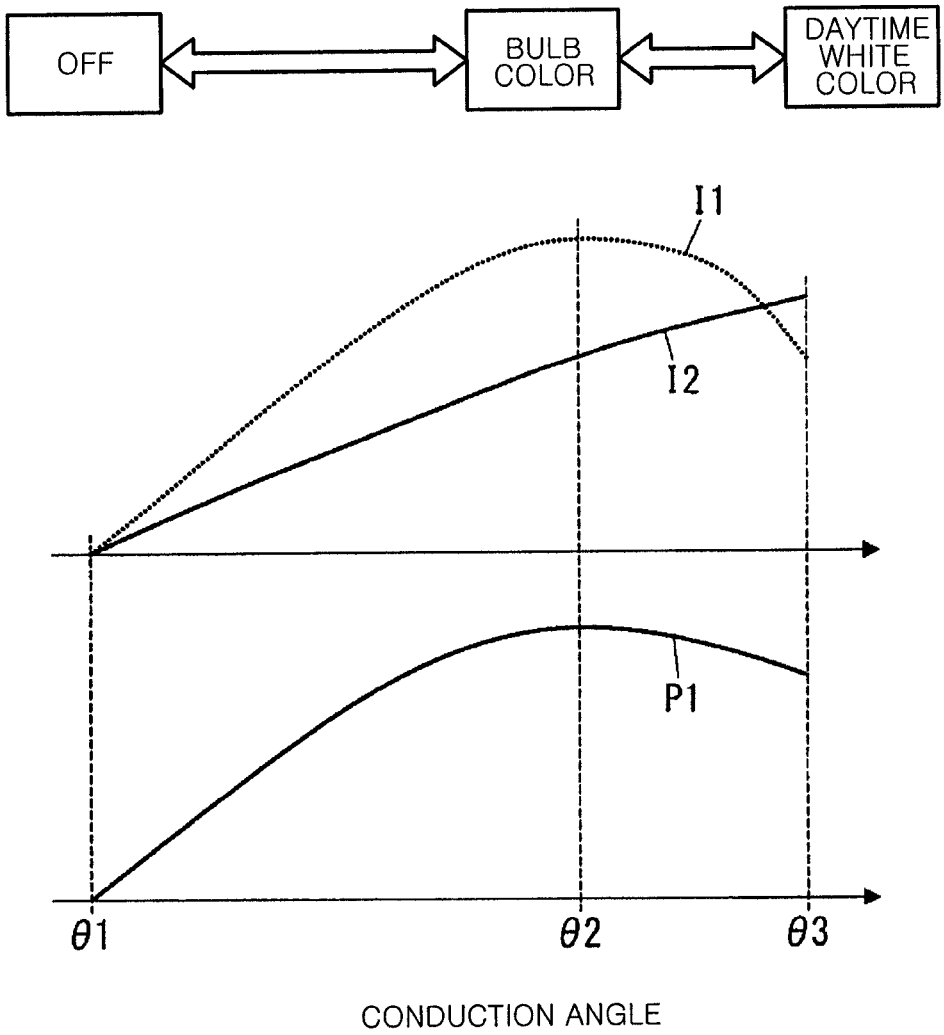
FIGS. 3 to 5 are diagrams for explaining an operation of the lighting device of the embodiment.

FIG. 3 is a graph showing a relationship between the conduction angle by the setting unit 20 and each of a current I1 flowing through the light source module 6*a*, a current I2 flowing through the light source module 6*b*, and a sum P1 of output powers of the second converter circuits 51*a* and 51*b*.

In the present embodiment, the lighting device 1 performs dimming in such a way that daytime white light is outputted as illumination light (mixed color light of the output lights of the light source modules 6*a* and 6*b*) if the conduction angle is set to the maximum value θ3 (i.e., upper limit of an adjustment range of the conduction angle), and warm white light is outputted as illumination light in between the middle of the upper limit of the adjustment range of the conduction angle and a lower limit thereof.

Further, the lighting device 1 controls the outputs of the second converter circuits 51*a* and 51*b* such that the sum P1 of the output powers thereof is maximized in the middle of the adjustment range of the conduction angle. The lighting device 1 performs lighting to output the bulb colored light in a state where the sum P1 of the output powers is the maximum.

The illumination device using the lighting device 1 of the present embodiment includes the light source module 6*a* of warm colors and the light source module 6*b* of cool colors. Thus, dimming is performed by controlling a ratio (current ratio) of the current flowing through the light source module 6*a* of warm colors to the current flowing through the light source module 6*b* of cool colors. Further, in order to obtain substantially the same brightness in the bulb colored illumination and the daytime white illumination, the current flowing in the bulb colored illumination is set to be higher than the current flowing in the daytime white illumination.

Thus, the lighting device 1 monotonically increases the current I2 flowing through the light source module 6*b* of cool colors in order to increase the light quantity from the lower limit to the upper limit of the adjustment range of the conduction angle. Further, the lighting device 1 gradually increases the current I1 flowing through the light source module 6*a* of warm colors from the lower limit to the middle of the adjustment range of the conduction angle, and adjusts the current I1 such that a value of the current I1 is maximized at the conducting angle at which the sum P1 of the output powers is the maximum.

Figure 4:
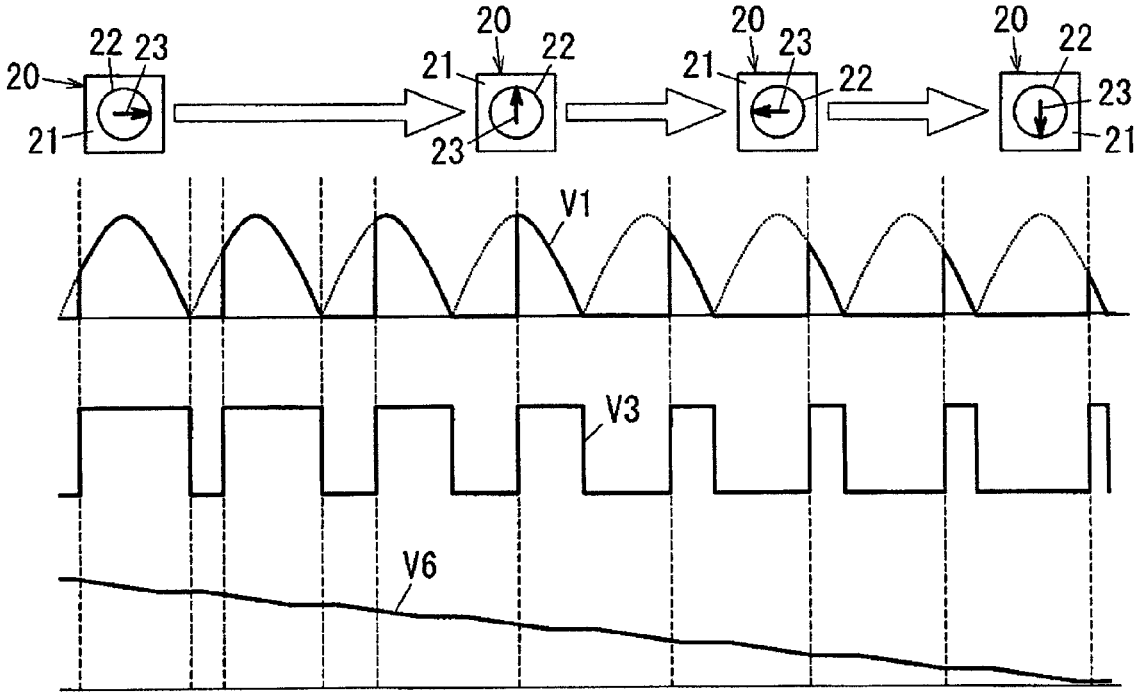

FIG. 4 shows a relationship between an operation position of an operating unit 22 included in the setting unit 20, the setting signal V1, the PWM signal V3 and the output voltage V6 of the smoothing circuit 8*c*. Further, FIG. 5 shows a relationship between an operation position of the operating unit 22 included in the setting unit 20, the setting signal V1 and the sum P1 of the output powers of the second converter circuits 51*a* and 51*b*.

Figure 5:
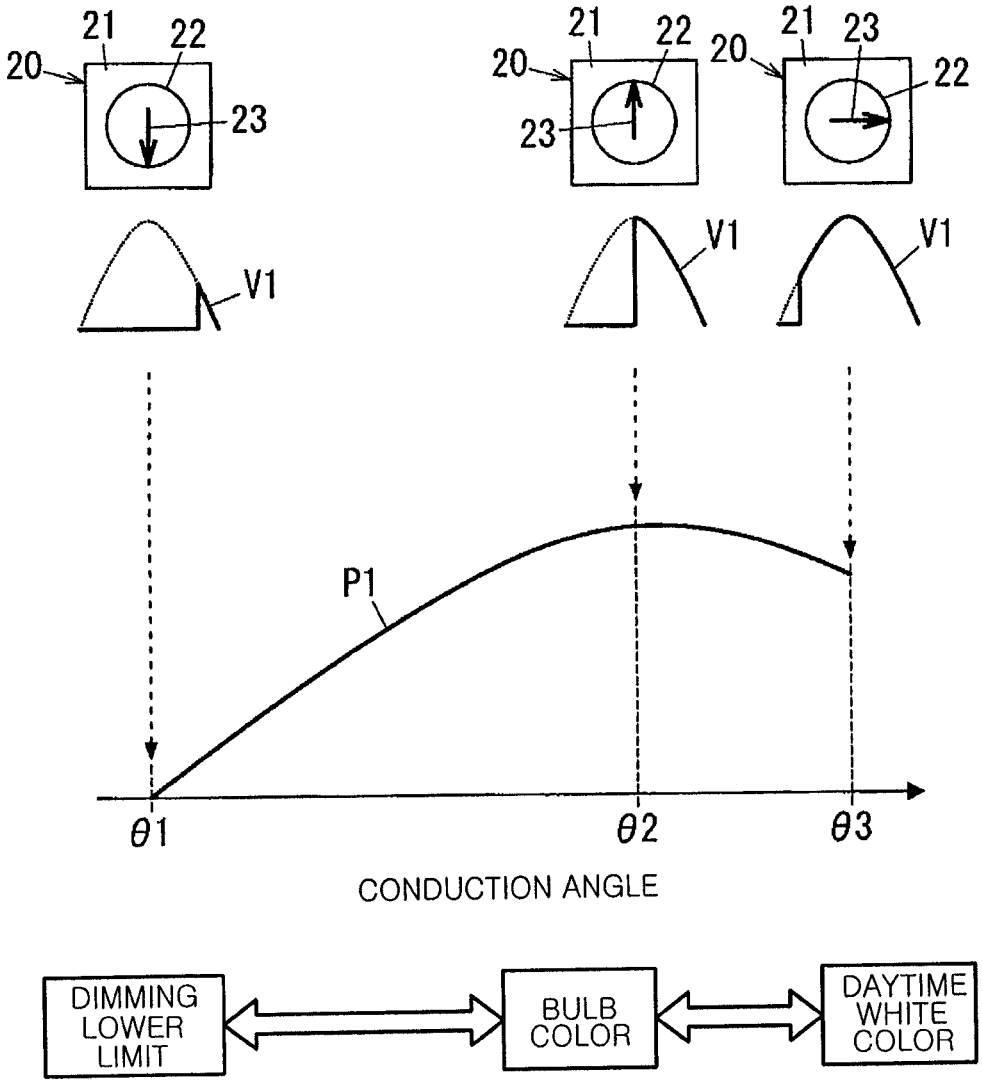

As shown in FIGS. 4 and 5, the setting unit 20 includes a main body 21 and the operating unit 22 rotatably installed thereto. The operating unit 22 is formed of a cylindrical knob, and a mark 23 indicating the operation position is formed on the surface thereof by an appropriate method such as engraving and printing. The operating unit 22 is configured to be rotated, when a position where the mark 23 is oriented toward the vertical upper side is assumed to be 0°, between a position of the mark 23 rotated counterclockwise by 180° from the position of 0° and a position of the mark 23 rotated clockwise by 90° from the position of 0°. The operation angle range of the operating unit 22 is exemplary, and may be appropriately changed.

In a state where the mark 23 is set to the position rotated counterclockwise by 180° by rotating the operating unit 22, the conduction angle of the setting signal V1 inputted from the setting unit 20 is minimized, and the on-duty ratio of the PWM signal V3 and the output voltage V6 are also minimized. The first control circuit 9 determines the duty ratios of the drive signals to be outputted to the second converter circuits 51*a* and 51*b* based on the output voltage V6, and turns on or off the light source modules 6*a* and 6*b* at the dimming lower limit.

As the operating unit 22 is rotated clockwise from the position of the mark 23 rotated counterclockwise by 180°, the conduction angle of the setting signal V1 increases. Accordingly, the on-duty ratio of the PWM signal V3 and the output voltage V6 also increase. The first control circuit 9 determines the duty ratios of the drive signals to be outputted to the second converter circuits 51*a* and 51*b* based on the output voltage V6, and performs the toning and the dimming by increasing the sum P1 of the output powers according to an increase in the conduction angle.

In a state where the mark 23 is set to the position of 0° by rotating the operating unit 22, the output voltage V6 corresponding to the conduction angle of the setting signal V1 is inputted to the first control circuit 9. The first control circuit 9 determines the duty ratios of the drive signals to be outputted to the second converter circuits 51*a* and 51*b* based on the output voltage V6, and controls the currents flowing through the light source modules 6*a* and 6*b* to perform the toning such that the illumination light becomes bulb colored light. In this case, the sum P1 of the output powers of the second converter circuits 51*a* and 51*b* becomes the maximum.

In a state where the mark 23 is set to the position rotated clockwise by 90° from the position of 0° by rotating the operating unit 22, the conduction angle of the setting signal V1 is maximized and the on-duty ratio of the PWM signal V3 and the output voltage V6 are also maximized. In this case, the first control circuit 9 determines the duty ratios of the drive signals to be outputted to the second converter circuits 51*a* and 51*b* based on the output voltage V6. The sum P1 of the output powers is lowered from the maximum value, and the illumination light is toned to be daytime white light.

As described above, in the setting unit 20, since the position where the illumination light becomes warm white light is set to the position of the mark 23 oriented toward the vertical upper side, it is easy to realize the position for lighting in bulb color. Also, in the setting unit 20, one end of the adjustment range of the operating unit 22 is set to the position of the dimming lower limit, and the other end of the adjustment range of the operating unit 22 is set to the position for lighting in daytime white. Thus, the user can easily realize the operation position of the operating unit 22 at the dimming lower limit, the operation position of the operating unit 22 for lighting in bulb color, and the operation position of the operating unit 22 for lighting in daytime white.

In the illumination device using the lighting device 1 of the present embodiment, the color temperature of the illumination light obtained by mixing the output lights of the light source modules 6*a* and 6*b* is changed between the bulb color and the daytime white, but may be varied between bulb color and daylight white having a color temperature higher than the daytime white. Further, in "Classification of Fluorescent Lamps and LEDs by Light Source Color and Color Rendering" of JIS Z 9112, a chromaticity range of daylight white is defined in the xy chromaticity diagram, and the correlated color temperature of the daylight white ranges from 5700 K to 7100 K. In general, since there is known an effect that characters are easily visible at the color temperature of about 6200 K, preferably, the lighting device 1 may vary the color temperature of the mixed color light between the bulb color and the daylight white.

Figure 6:
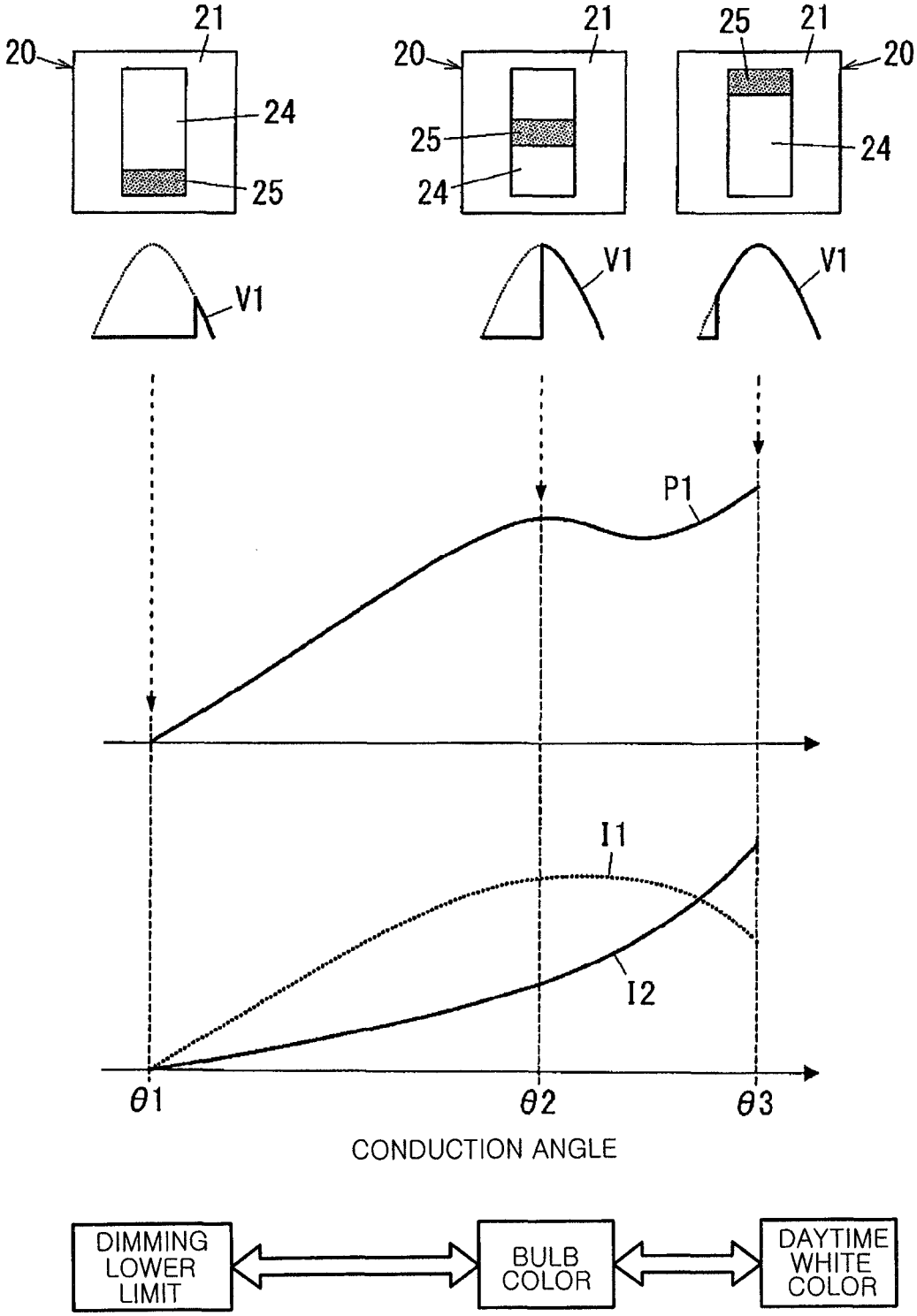
FIG. 6 is a diagram for explaining another example of a setting unit of the lighting device according to the embodiment.

FIG. 6 is a graph showing a relationship between an operation position of an operating unit 24 of another example included in the setting unit 20, the setting signal V1, the sum P1 of output powers of the second converter circuits 51*a* and 51*b*, the current I1 flowing through the light source module 6*a*, and the current I2 flowing through the light source module 6*b*.

In the example shown in FIG. 6, the setting unit 20 includes the operating unit 24 which is slidably mounted on the main body 21 of the setting unit 20. The operating unit 24 has a protrusion 25 which protrudes from the surface of the main body 21 (i.e., the paper surface), and is configured to change the conduction angle of the setting signal V1 by sliding the protrusion 25 in the up-down direction in FIG. 6.

As shown in FIG. 6, when the protrusion 25 is located at a position (e.g., the lower end position in FIG. 6) at one end of the adjustment range by operating the operating unit 24, the conduction angle of the setting signal V1 becomes the minimum value θ1. In this case, the first control circuit 9 turns on the light source modules 6*a* and 6*b* at the dimming lower limit. Alternatively, when the conduction angle of the setting signal is the minimum value θ1, the first control circuit 9 may turn off the light source modules 6*a* and 6*b*.

Between the position (lower end position in FIG. 6) at the one end of the adjustment range and an intermediate position of the adjustment range of the protrusion 25, the conduction angle is increased or decreased in accordance with the operation position of the protrusion 25, and toning and dimming are accordingly performed.

If the protrusion 25 is located at the intermediate position (the middle position in the up-down direction in FIG. 6) of the adjustment range by operating the operating unit 24, the conduction angle of the setting signal V1 becomes θ2, and the first control circuit 9 controls the second converter circuits 51*a* and 51*b* such that the sum P1 of output powers becomes the maximum. At this time, the current I1 flowing through the light source module 6*a* is maximized, and the mixed color light becomes light having a color temperature of 2800 K (bulb color).

If the protrusion 25 is located at the position (the upper end position in FIG. 6) at the other end of the adjustment range by operating the operating unit 24, the conduction angle of the setting signal V1 becomes θ3. The first control circuit 9 controls the second converter circuits 51*a* and 51*b* such that a variation curve of the sum P1 of output powers has a point of inflection between the conduction angles θ2 and θ3 of the setting signal V1. Thus, while the conduction angle of the setting signal V1 changes from the inflection point to θ3, the sum P1 of output powers increases with an increase of the conduction angle. When the conduction angle becomes θ3, the color temperature of the mixed color light is 6200 K, and daylight white light is outputted.

As the above, the sum P1 of output powers of the second converter circuits 51*a* and 51*b* has the characteristic curve as shown in FIG. 6 including a first inflection point at the conduction angle θ2 with the color temperature of 2800K and a second inflection point at the conduction angle with the color temperature of 5000K.

Figure 7:
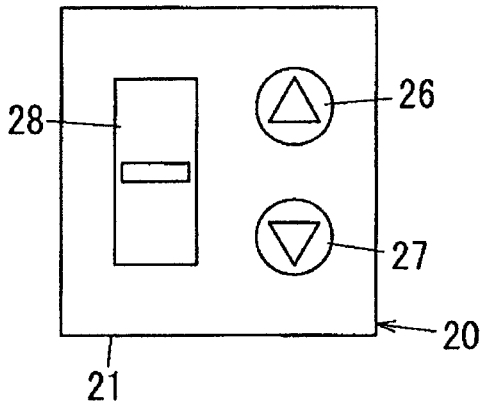
FIG. 7 is a diagram for explaining still another example of the setting unit of the lighting device according to the embodiment.

Further, the operating unit is not limited to the rotating type or the sliding type operating unit. For example, as shown in FIG. 7, the operating unit may be an operating unit including a first button 26 for increasing the conduction angle, a second button 27 for decreasing the conduction angle, and a display unit 28 such as a level meter which displays the setting of the conduction angle.

As described above, the lighting device 1 of the present embodiment includes the AC to DC conversion unit 2, the voltage conversion unit (second converter circuits 51*a* and 51*b*), the PWM signal generating unit (PWM signal generating circuit 7) and the control unit (first control circuit 9). When setting unit 20 generates a setting signal by adjusting the conduction angle of the AC voltage inputted from the AC power source 100 and outputs the setting signal to the AC to DC conversion unit 2, the AC to DC conversion unit 2 rectifies and smoothes the setting signal to be converted into a DC voltage of a predetermined voltage value. The voltage conversion unit converts the voltage level of the DC voltage outputted from the AC to DC conversion unit 2, and outputs it to a plurality of the light source modules 6*a* and 6*b*, each having solid-state light emitting elements.

The PWM signal generating unit receives the setting signal inputted from the setting unit 20, and generates the PWM signal having the duty ratio corresponding to the magnitude of the conduction angle of the setting signal. The control unit controls the output of the voltage conversion unit based on the command value determined according to the duty ratio of the PWM signal. Further, the control unit controls the output power of the voltage conversion unit such that the characteristic curve of the output power of the voltage conversion unit has the maximum or at least one inflection point within the adjustment range of the conduction angle.

As described above, the lighting device 1 controls the output power such that the characteristic curve of the output power has the maximum or at least one inflection point within the adjustment range of the conduction angle. Therefore, by adjusting the conduction angle by the setting unit 20, it is possible to switch from lighting at the dimming lower limit to one of a state of lighting in bulb color and a state of lighting in daytime white or daylight white. Thus, by simply inputting the setting signal from the setting unit 20 to the lighting device 1, the toning and the dimming of the light source modules 6*a* and 6*b* can be performed. Since the setting unit 20 and the lighting device 1 can be connected to each other through two wires, an additional wire is not necessary, and installation work can be easily performed.

Further, the lighting device 1 of the present embodiment is configured to drive a plurality of the light source modules 6*a* and 6*b* emitting in different colors. The light source modules 6*a* and 6*b* include the first light source module (light source module 6*a*) having a relatively low color temperature and the second light source module (light source module 6*b*) having a relatively high color temperature. Further, the control unit controls the outputs of the voltage conversion units such that the current flowing through the second light source module gradually increases with an increase in the conduction angle, and the output curve of the current flowing through the first light source module has the maximum or at least one inflection point within the adjustment range of the conduction angle.

As described above, in the lighting device 1, the outputs of the voltage conversion units are controlled such that the characteristic curve of the current flowing through the first light source module having a relatively low color temperature has the maximum or at least one inflection point within the adjustment range of the conduction angle. Therefore, by adjusting the conduction angle by the setting unit 20, it is possible to switch from lighting at the dimming lower limit to one of a state of lighting in bulb color and a state of lighting in daytime white or daylight white. Thus, by simply inputting the setting signal from the setting unit 20 to the lighting device 1, the toning and the dimming of the light source modules 6*a* and 6*b* can be performed. Since the setting unit 20 and the lighting device 1 can be connected to each other through the two wires, an additional wire is not necessary, and installation work can be easily performed.

In addition, the lighting device 1 of the present embodiment includes the smoothing unit (smoothing circuit 8*c*) to generate the DC voltage of the voltage value corresponding to the duty ratio of the PWM signal V3 by smoothing the PWM signal V3. The control unit (first control circuit 9) may determine the command value based on the output of the smoothing unit. In this case, since the output of the smoothing unit is the voltage value corresponding to the duty ratio of the PWM signal V3, the control unit can determine the command value according to the duty ratio of the PWM signal V3.

In the lighting device 1 of the present embodiment, the control unit (first control circuit 9) may control the output of the voltage conversion unit such that the color temperature of the mixed color light becomes a first color temperature smaller than that of the bulb color at the conduction angle at which the quantity of the output light from the light source modules 6*a* and 6*b* is the minimum. The control unit may control the outputs of the voltage conversion units such that the color temperature of the mixed color light becomes a second color temperature equal to or greater than that of the daytime white at the conduction angle at which the quantity of the output light from the light source modules 6*a* and 6*b* is the maximum. Further, the control unit may control the outputs of the voltage conversion units such that the color temperature of the output light varies between the first color temperature and the second color temperature according to the conduction angle.

Thus, the control unit may vary the color temperature of the mixed color light (light obtained by mixing the output lights of the light source modules 6*a* and 6*b*) between the first color temperature and the second color temperature according to the conduction angle which is adjusted by the setting unit 20.

In addition, in the lighting device 1 of the present embodiment, the control unit (first control circuit 9) may control the outputs of the voltage conversion units such that the mixed color light of the light source modules 6*a* and 6*b* becomes bulb colored light at the conduction angle at which the characteristic curve of the sum P1 of the outputs of the voltage conversion units is maximized or has an inflection point.

Accordingly, it is possible to switch from a state of lighting at the dimming lower limit to one of a state of lighting in bulb color and a state of lighting in daytime white or daylight white.

In addition, the illumination device of the present embodiment includes the above-described lighting device 1, and an illumination load having the light source modules 6*a* and 6*b* which are turned on and off by the lighting device 1. By employing the above-described lighting device 1, an additional wire is not required, and it is possible to realize an illumination device capable of facilitating installation work.

Figure 16:
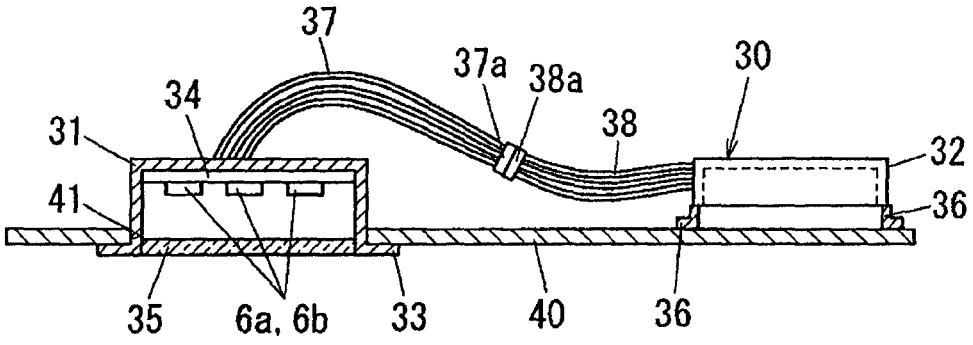
FIG. 16 is a schematic cross-sectional view of the illumination apparatus in accordance with still another embodiment.

In the present embodiment, the illumination apparatus, which will be described with reference to FIG. 16 later, includes the above-described illumination device, and an apparatus main body (e.g., first case 31 shown in FIG. 16) to which the illumination load (light source modules 6*a* and 6*b*) is attached. By providing the above-described illumination device, an additional wire is not required, and it is possible to realize an illumination apparatus capable of facilitating installation work.

In addition, the illumination system, which will be described with reference to FIG. 16 later, includes the above-described illumination apparatus, and the setting unit 20 having the operating unit 22 or 24. The setting unit 20 outputs the setting signal generated by adjusting the conduction angle of the AC voltage inputted from the AC power source according to the operation of the operating unit 22 or 24, to the illumination apparatus. By providing the above-described illumination apparatus, an additional wire is not required, and it is possible to realize an illumination system capable of facilitating installation work.

In an example of the illumination system, the operating unit 22 is rotatably provided in the main body 21 of the setting unit 20, and the mark 23 indicating the operation position is provided in the operating unit 22. In a state where the main body 21 is attached to the wall, the control unit may control the outputs of the voltage conversion units such that the characteristic curve of the sum P1 of the output powers of the voltage conversion units has the maximum or an inflection point when the operating unit 22 is rotated to the operation position in which the mark 23 is oriented to the vertical upper side. Thus, when the operating unit 22 is operated to the operation position in which the mark 23 is oriented to the vertical upper side, the sum P1 of the output powers of the voltage conversion units becomes the maximum and lighting is performed with bulb colored light. Accordingly, the operation position for lighting in bulb color can be easily realized.

In another example of the illumination system, the operating unit 24 is slidably provided in the main body 21 of the setting unit 20, and a mark (protrusion 25) indicating the operation position is formed in the operating unit 24. The control unit may control the outputs of the voltage conversion units such that the characteristic curve of the sum P1 of the output powers of the voltage conversion units has the maximum or an inflection point when the operating unit 24 is operated and the mark is positioned at a position within the adjustment range of the operating unit 24. Thus, when the operating unit 24 is operated and the protrusion 25 is positioned at the center of the adjustment range, the sum P1 of the output powers of the voltage conversion units becomes the maximum or an inflection point, and lighting is performed with bulb colored light or daytime white light. Accordingly, the operation position for lighting in bulb color or daytime white can be easily known.

In still another example of the illumination system, as an operating unit, the first button 26 for up-operation and the second button 27 for down-operation may be provided in the main body 21 of the setting unit 20, and the display unit 28 may be provided to display the level of the setting value of the conduction angle. It is also preferable that the control unit controls the outputs of the voltage conversion units such that the characteristic curve of the sum P1 of the output powers of the voltage conversion units has the maximum or an inflection point in a state where the operating unit is operated and the level of the conduction angle displayed in the display unit 28 is positioned in the middle of the display range. Thus, by operating the first button 26 and the second button 27, when the level of the setting value of the conduction angle displayed on the display unit 28 is set to the middle of the display range, the sum of the output powers of the voltage conversion units becomes the maximum or has an inflection point, and lighting is performed with bulb colored light or daytime white light. Accordingly, the operation position for lighting in bulb color or daytime white can be easily realized.

Second Embodiment

A lighting device according to a second embodiment, and an illumination device, an illumination apparatus and an illumination system including the same will be described with reference to FIGS. 8 to 16.

Figure 8:
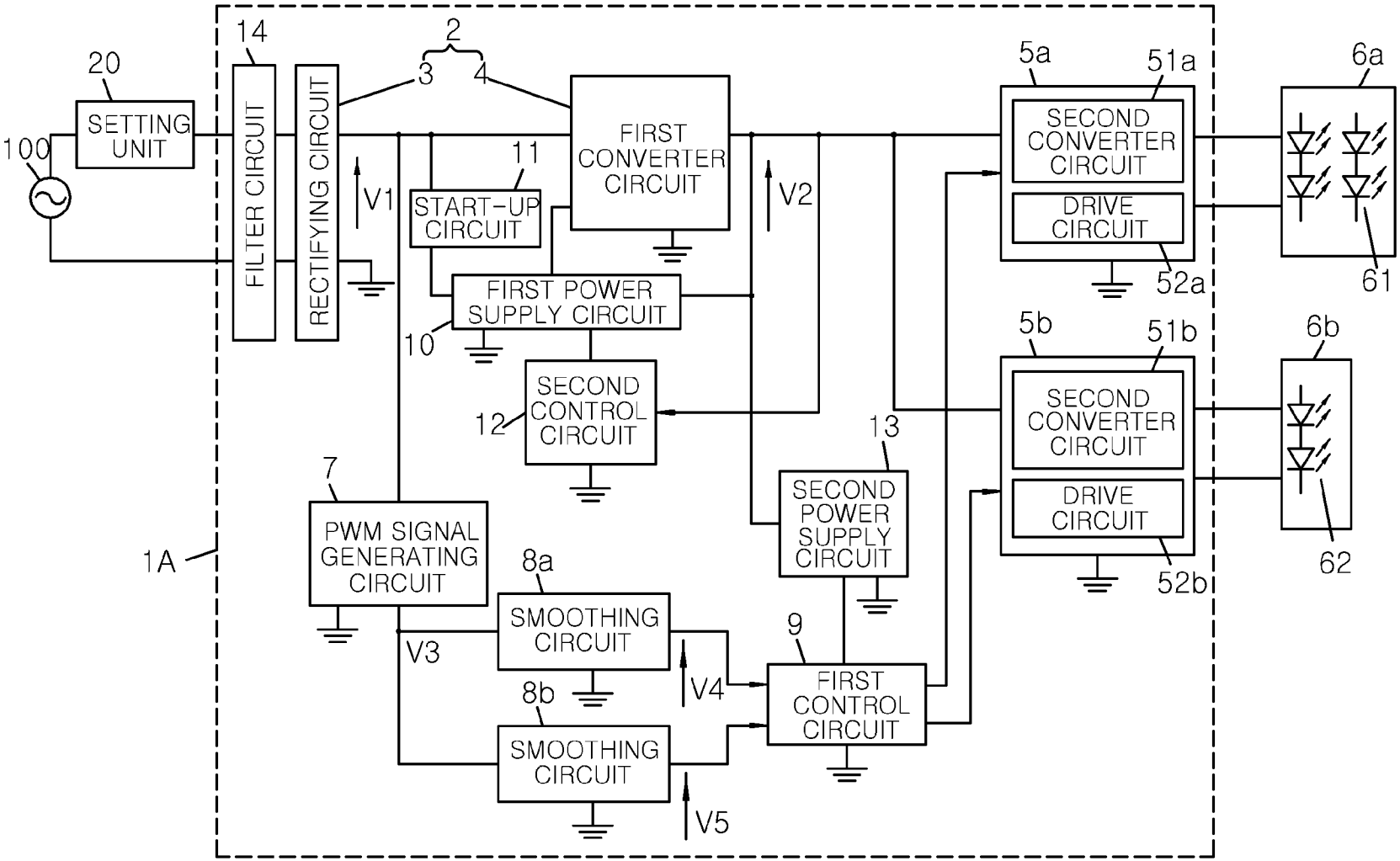
FIG. 8 is a schematic block circuit diagram of a lighting device in accordance with another embodiment.

As shown in FIG. 8, a lighting device 1A of the present embodiment includes an AC to DC conversion unit 2, second converter circuits 51*a* and 51*b*, a PWM signal generating circuit 7, smoothing circuits 8*a* and 8*b*, and a first control circuit 9. The lighting device 1A of the present embodiment further includes a first power supply circuit 10, a start-up circuit 11, a second control circuit 12, a second power supply circuit 13, a filter circuit 14, and drive circuits 52*a* and 52*b*. The lighting device 1A turns on and off light source modules 6*a* and 6*b*. The lighting device 1A of the present embodiment is different from the first embodiment in that it includes two smoothing circuits 8*a* and 8*b*, and in common with the first embodiment except for the difference. Thus, the same components as the first embodiment are denoted by the same reference numerals, and a description thereof will be omitted.

In the present embodiment, color temperature of light irradiated from the light source module 6*a* is different from that of light irradiated from the light source module 6*b*, and light (mixed color light) obtained by mixing the light (having a color temperature of about 2000K) irradiated from the light source module 6*a* and the light (having a color temperature of about 8000K) irradiated from the light source module 6*b* is irradiated.

A setting unit 20 serves as a dimming unit used for a user to set the color temperature and the quantity of the light (mixed color light) obtained by mixing the light irradiated from the light source module 6*a* and the light irradiated from the light source module 6*b*. The setting unit 20 includes a switching element connected in series to an AC power source 100, generates a setting signal by adjusting a conduction angle of the switching element, and outputs the setting signal to the lighting device 1A.

Figure 9:
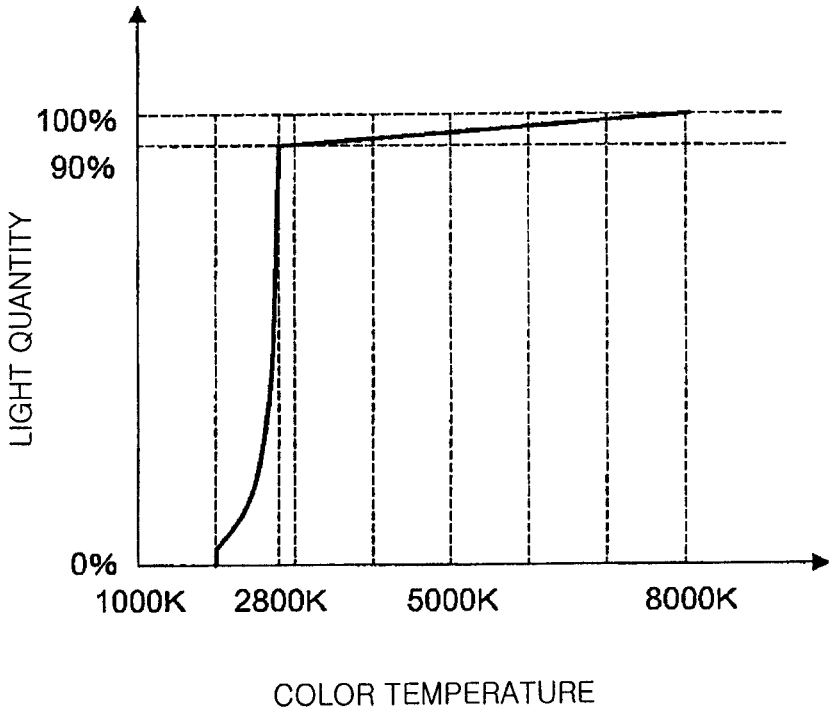
FIG. 9 is a diagram for explaining toning and dimming characteristics of the lighting device shown in FIG. 8.

In the lighting device 1A of the present embodiment, the color temperature and the quantity of the mixed color light are changed according to the conduction angle of the setting signal, and toning and dimming are performed according to a toning-dimming curve as shown in FIG. 9. As in the first embodiment, the term "conduction angle" means a range of a phase angle at which the switching element included in the setting unit 20 is conducting. For example, in the example of FIG. 11, the conduction angle is 150 degrees before time t1 and the conduction angle is 30 degrees after time t1.

In the present embodiment, the setting unit 20 operates in a leading edge mode, but the setting unit 20 may operate in a trailing edge mode. In the case of the trailing edge mode, the setting unit 20 turns on the switching element until it reaches a phase angle set by a setting knob from the zero cross of an AC voltage, and turns off the switching element from the phase angle set by the setting knob to the next zero cross. Thus, in the present embodiment, an AC voltage obtained by clipping a portion of a sinusoidal waveform is outputted from the setting unit 20 to the lighting device 1A from the phase angle set by the setting volume to the next zero cross every half cycle of an AC power supply voltage.

Figure 10:
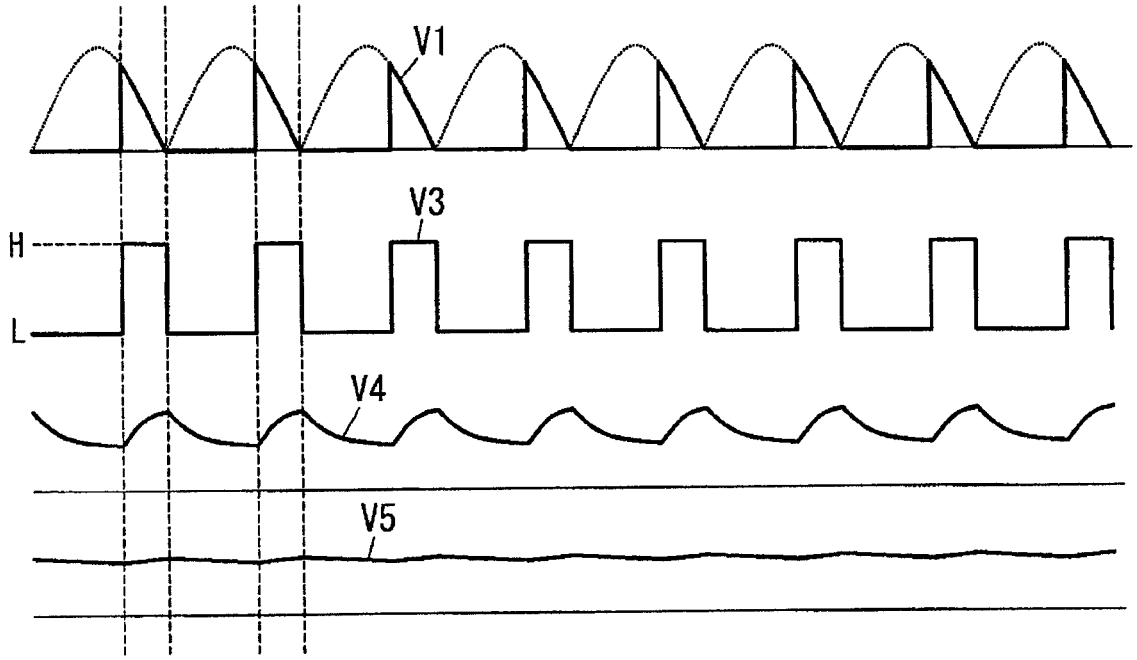
FIGS. 10 to 13 are diagrams for explaining an operation of the lighting device of the embodiment shown in FIG. 8.

The setting signal inputted to the lighting device 1A from the setting unit 20 is inputted to the PWM signal generating circuit 7 after being full-wave rectified by the rectifying circuit 3. FIG. 10 shows a waveform diagram of each of a voltage signal V1 outputted from the rectifying circuit 3, a PWM signal V3 outputted from the PWM signal generating circuit 7, an output voltage V4 of the smoothing circuit 8*a*, and an output voltage V5 of the smoothing circuit 8*b*.

The PWM signal generating circuit 7 outputs the PWM signal V3 of a duty ratio corresponding to the conduction angle of the setting signal inputted from the setting unit 20. The PWM signal V3 outputted from the PWM signal generating circuit 7 is inputted to each of the two smoothing circuits 8*a* and 8*b* (smoothing unit, a second signal generating unit).

The smoothing circuit 8*a* includes, e.g., a RC integration circuit (not shown) in which a resistor and a capacitor are connected in series between the ground and the output terminal of the PWM signal generating circuit 7. A voltage obtained by smoothing the PWM signal V3 is generated across the capacitor. Therefore, the smoothing circuit 8*a* generates the DC voltage V4 of a voltage value according to the duty ratio of the PWM signal V3, and outputs the DC voltage V4 to the first control circuit 9.

Similarly to the smoothing circuit 8*a*, the smoothing circuit 8*b* also includes a RC integration circuit (not shown) in which a resistor and a capacitor are connected in series between the ground and the output terminal of the PWM signal generating circuit 7. A DC voltage obtained by smoothing the PWM signal V3 is generated across the capacitor. Therefore, the smoothing circuit 8*b* generates the DC voltage V5 of a voltage value according to the duty ratio of the PWM signal V3, and outputs the DC voltage V5 to the first control circuit 9.

The first control circuit 9 includes an analog to digital conversion unit (not shown) to digitally convert each of the output voltage V4 of the smoothing circuit 8*a* and the output voltage V5 of the smoothing circuit 8*b*, and acquire the converted voltage. The first control circuit 9 acquires the converted output voltages V4 and V5 by digitally converting the analogue output voltages V4 and V5 at a predetermined timing.

Based on the acquired output voltages V4 and V5, the first control circuit 9 controls the outputs of the second converter circuits 51*a* and 51*b* to change the light outputs of the light source modules 6*a* and 6*b*. Thus, by changing the light outputs of the light source modules 6*a* and 6*b* having emission colors different in color temperature and mixing the output lights of the light source modules 6*a* and 6*b*, the output light in accordance with the toning-dimming curve as shown in FIG. 9 is irradiated. Further, in the toning-dimming curve as shown in FIG. 9, the toning-dimming curve with the light quantity ranging from 0% to 90% is set to be consistent with a dimming curve in the case of an incandescent lamp.

In the present embodiment, a time constant of the RC integration circuit included in the smoothing circuit 8*b* is set to a value greater than a time constant of the RC integration circuit included in the smoothing circuit 8*a*.

Specifically, in the smoothing circuit 8*b*, the time constant is set to a value sufficiently greater than the half cycle of the AC voltage such that a voltage ripple of the output voltage V5 becomes as small as possible. Therefore, even though the timing at which the first control circuit 9 acquires the output voltage V5 is slightly deviated, since the value of the acquired output voltage V5 is rarely changed, a restriction on the timing at which the first control circuit 9 acquires the output voltage V5 is reduced. Further, since the voltage ripple of the output voltage V5 has a sufficiently small value, the first control circuit 9 is not required to average the acquired output voltage V5, which eliminates the need for an averaging process. Further, although a distortion due to noise or a voltage variation is superimposed on the power supply voltage of the AC power source 100 and accordingly the duty ratio of the PWM signal V3 is varied, since the time constant of the smoothing circuit 8*b* is set to a value sufficiently greater than the half cycle of the AC voltage, the variation of the output voltage V5 is suppressed.

Further, in the smoothing circuit 8*a*, the time constant is set to a value greater than the half cycle of the AC voltage and sufficiently smaller than the time constant of the smoothing circuit 8*b*. Accordingly, the average voltage of the output voltage V4 can follow, with good responsiveness, a change in the duty ratio of the PWM signal V3 although the voltage ripple of the output voltage V4 is relatively larger than that of the output voltage V5. Therefore, the average voltage of the output voltage V4 of the smoothing circuit 8*a* changes with a change in the duty ratio of the PWM signal V3.

However, as shown in FIG. 10, since the output voltage V4 greatly varies during each period of high and low of the PWM signal V3, the value acquired by analog to digital converting the output voltage V4 may greatly vary depending on the timing of acquiring the output voltage V4. In the present embodiment, since the first control circuit 9 digitally converts the analogue output voltage V4 at a substantially same timing within one cycle in synchronization with the frequency of the voltage signal V1, it is possible to suppress the analog to digital converted value from being varied at the timing of acquiring output voltage V4.

Figure 11:
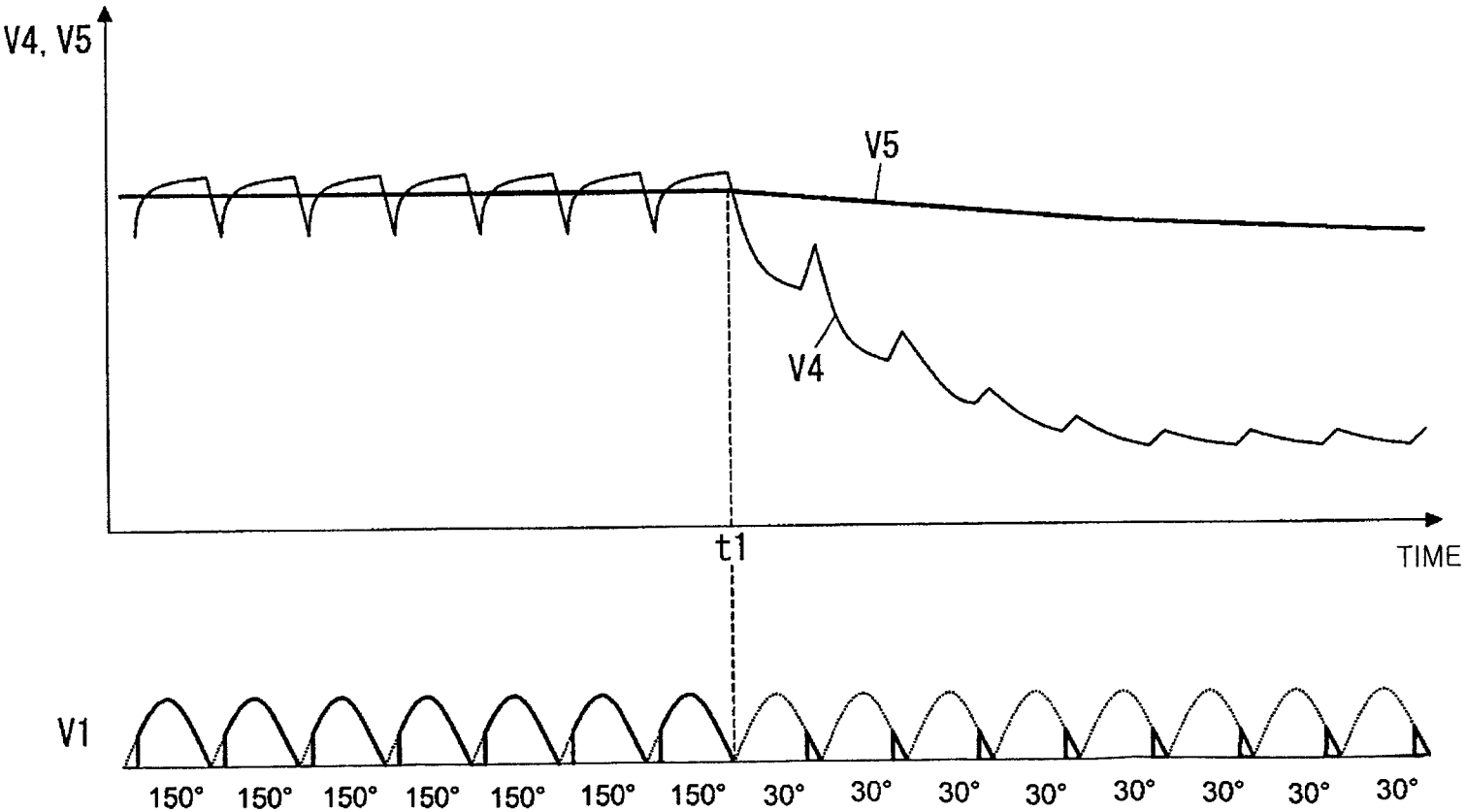

FIG. 11 shows an example of the voltage signal V1 inputted from the rectifying circuit 3. As shown in FIG. 11, since the power supply voltage is inputted from a time point at which the phase angle is 30 degrees to the next zero cross every half cycle before the time t1, the conduction angle of the power supply voltage (range of the phase angle in which the power supply voltage is supplied) is set to 150 degrees. Further, since the power supply voltage is supplied from a time point at which the phase angle is 150 degrees to the next zero cross every half cycle after the time t1, the conduction angle of the power supply voltage is set to 30 degrees.

FIG. 11 further shows waveform diagrams of the output voltage V4 of the smoothing circuit 8*a* and the output voltage V5 of the smoothing circuit 8*b* before and after the conduction angle of the voltage signal V1 changes from 150 degrees to 30 degrees. Since the time constant of the smoothing circuit 8*a* is set to a value smaller than the time constant of the smoothing circuit 8*b*, the average voltage of the output voltage V4 after the time t1 changes quickly compared to the average voltage of the output voltage V5, and favorably follows the change in the duty ratio of the PWM signal V3.

The first control circuit 9 receives the output voltage V4 inputted from the smoothing circuit 8*a*, and the output voltage V5 inputted from the smoothing circuit 8*b*. The first control circuit 9 applies a weight for each of the two output voltages V4 and V5, and determines the command value V6 based on the weighted output voltages V4 and V5.

In the present embodiment, the first control circuit 9 multiplies the output voltage V4 by a weight coefficient n ($0 \le n \le 1$) and the output voltage V5 by a weight coefficient (1−n), and calculates an average thereof as the command value V6. That is, the first control circuit 9 calculates the command value V6 by using the following Eq. 1:

$$V6 = \frac{n \times V4 + (1-n) \times V5}{2} \quad \text{Eq. 1}$$

Specifically, the first control circuit 9 acquires the output voltage V4 from the smoothing circuit 8*a* and the output voltage V5 from the smoothing circuit 8*b* at a predetermined timing, and calculates the command value V6 by using Eq. 1. The first control circuit 9 includes a memory (not shown) in which a table associating the command value V6 with each of the output of the second converter circuit 51*a* and the output of the second converter circuit 51*b* is stored in advance. After calculating the command value V6 by using Eq. 1, the first control circuit 9 obtains the outputs of the second converter circuits 51*a* and 51*b* by referring to the memory, and controls the output lights of the light source modules 6*a* and 6*b* by controlling the outputs of the second converter circuits 51*a* and 51*b*.

In this case, the first control circuit 9 determines the weight coefficient n based on the values of the output voltage V4 and the output voltage V5.

If a difference between the output voltage V4 and the output voltage V5 is a predetermined first threshold value or less, the first control circuit 9 regards that the user does not change the conduction angle by using the setting unit 20 and a change in the duty ratio of the PWM signal V3 is small. Accordingly, the first control circuit 9 increases the weighting of the smoothing circuit 8*b* having a relatively large time constant. Specifically, the first control circuit 9 determines the value of the weight coefficient n such that the weight coefficient (1−n) of the output voltage V5 is larger than the weight coefficient n of the output voltage V4. For example, when the first control circuit 9 sets the weight coefficient n to zero, V6 is equal to V5/2. As a result, the command value V6 is determined by the output voltage V5 of the smoothing circuit 8*b* having the relatively large time constant.

Then, on the basis of the command value V6, the first control circuit 9 reads each of the output of the second converter circuit 51*a* and the output of the second converter circuit 51*b* from the table in the memory. The first control circuit 9 outputs the output of the second converter circuit 51*a* read from the table to the drive circuit 52*a* to control the output of the light source module 6*a*. Further, the first control circuit 9 outputs the output of the second converter circuit 51*b* read from the table to the drive circuit 52*b* to control the output of the light source module 6*b*. The first control circuit 9 controls individually outputs of the light source modules 6*a* and 6*b* to thereby adjust the light output and the color temperature of the mixed color light.

Since the time constant of the smoothing circuit 8*b* is set to a value larger than that of the smoothing circuit 8*a*, the output voltage V5 of the smoothing circuit 8*b* has a ripple voltage smaller than that of the output voltage V4 of the smoothing circuit 8*a* and is less influenced by noise. In the present embodiment, the first control circuit 9 increases the weighting of the output voltage V5 and determines the command value V6 based thereon. Therefore, it is possible to suppress an unintended change in the light output from arising due to the influence of the noise or voltage variation.

Further, if the difference between the output voltage V4 and the output voltage V5 exceeds the first threshold value, the first control circuit 9 regards that the user changes the conduction angle by using the setting unit 20, the duty ratio of the PWM signal V3 is changed and the output of the smoothing circuit 8*a* is changed accordingly. In this case, the first control circuit 9 increases the weighting of the smoothing circuit 8*a* having a relatively small time constant. Specifically, the first control circuit 9 sets the value of the weight coefficient n to, e.g., 0.6 such that the weight coefficient n of the output voltage V4 is larger than the weight coefficient (1−n) of the output voltage V5. When the value of the weight coefficient n is set to 0.6, the output V6 is obtained by the following Eq. 2.

$$V6 = \frac{0.6 \times V4 + 0.4 \times V5}{2} \quad \text{Eq. 2}$$

Thus, in the case where the duty ratio of the PWM signal V3 is changed greatly, the weight coefficient of the smoothing circuit 8*a* having the relatively small time constant is set to be larger than the weight coefficient of the smoothing circuit 8*b* having the relatively large time constant. Accordingly, responsivity of the command value V6 for the change in the duty ratio of the PWM signal V3 is improved. The first control circuit 9 changes the outputs of the second converter circuits 51*a* and 51*b* based on the command value V6, thereby adjusting the color temperature and the quantity of the mixed color light obtained by mixing the outputs of the light source modules 6*a* and 6*b*.

Further, in the present embodiment, according to whether or not the difference between the output voltage V4 and the output voltage V5 exceeds the first threshold value, the weight coefficient n is set to one of two values. However, the weight coefficient n may be set to one of three or more values depending on the magnitude of the difference between the output voltage V4 and the output voltage V5.

As described above, the outputs of the second converter circuits 51*a* and 51*b* are controlled by the first control circuit 9 to follow a change in the conduction angle of the voltage signal V1 outputted from the rectifying circuit 3, and the light outputs of the light source modules 6*a* and 6*b* are changed accordingly. Therefore, it is possible to shorten a response delay until the light output is changed after the user operates the setting unit 20, and the user is less likely to feel a delay in control.

In the present embodiment, if the effective value of the voltage signal V1 is greatly reduced through the setting unit 20, the output voltage V2 of the first converter circuit 4 is controlled so as not to fall below the minimum operation voltage required for turning on the light source modules 6*a* and 6*b*. The details of the control will be described with reference to FIGS. 12 and 13.

Figure 12:
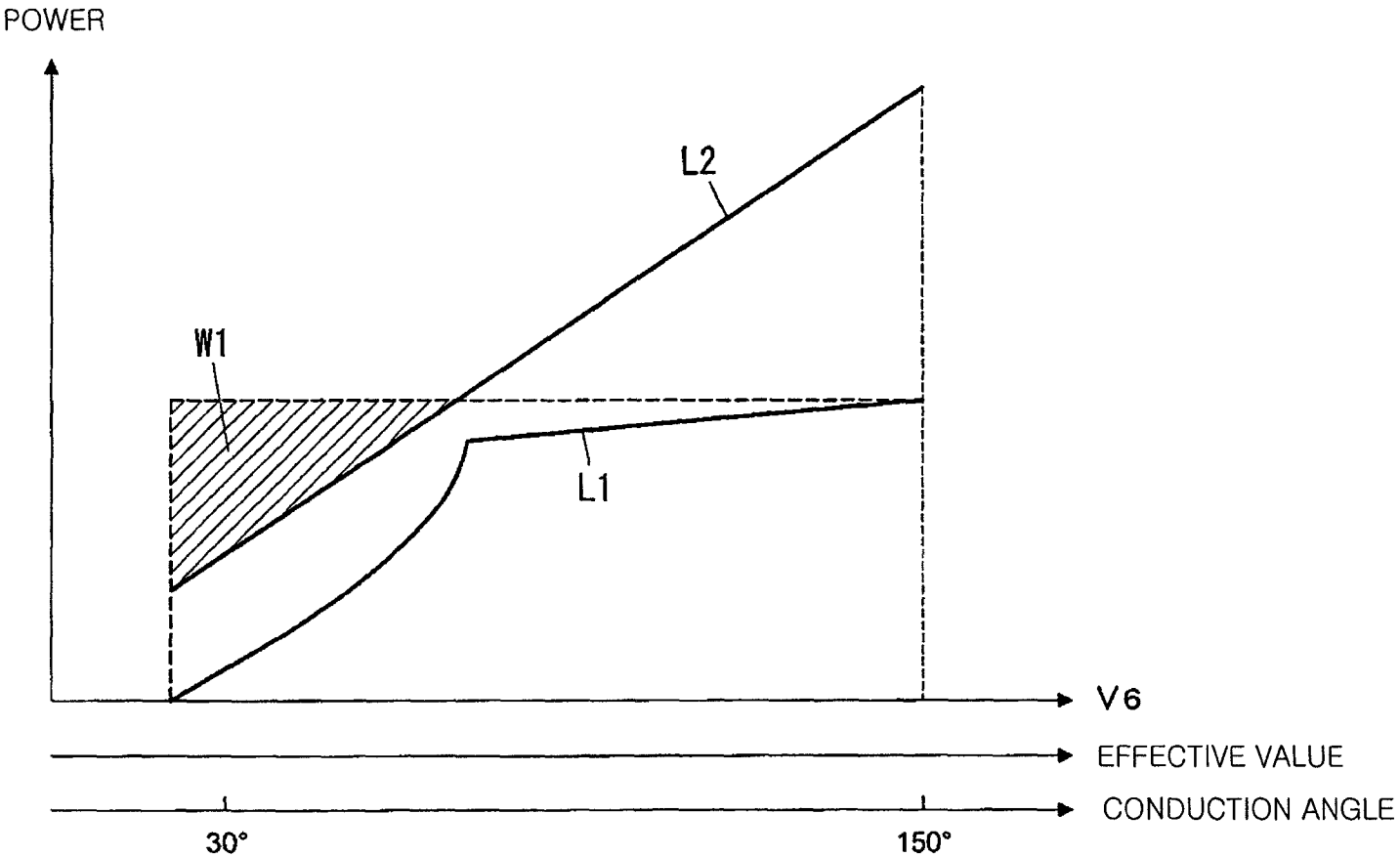

In FIG. 12, the solid line L1 indicates static characteristics of the lighting device 1A, i.e., the sum power of the output powers of the second converter circuits 51*a* and 51*b* with respect to the command value V6 or the conduction angle or the effective value of the voltage signal V1. Further, the solid line L2 of FIG. 12 shows a maximum power value that can be supplied from the first converter circuit 4 for the effective value of the voltage signal V1.

Figure 13:
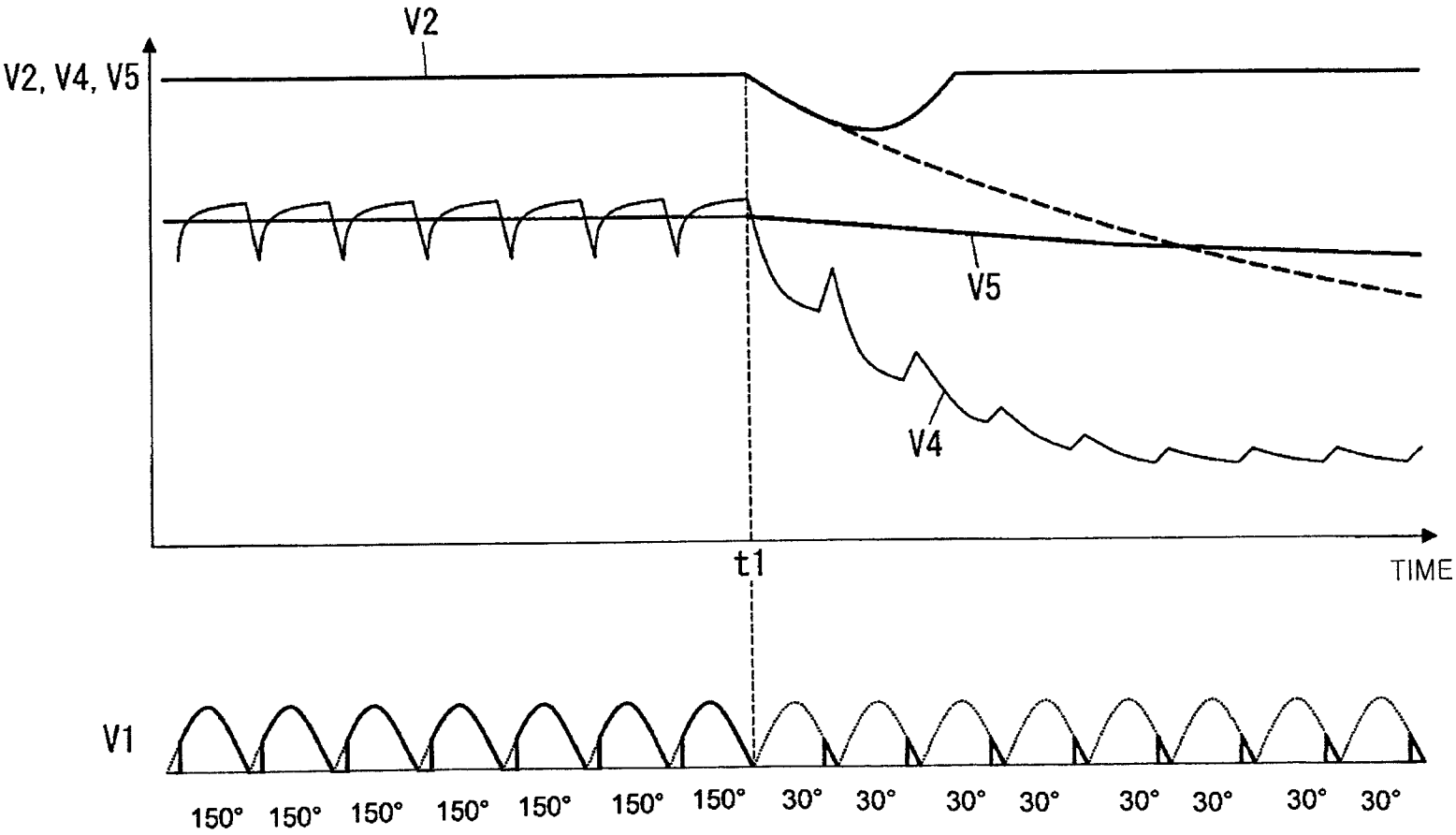

As shown in FIG. 13, since the conduction angle of the voltage signal V1 is set to 150 degrees before the time t1 and the sum of the output powers of the second converter circuits 51*a* and 51*b* is less than the maximum power that can be supplied from the first converter circuit 4, the voltage V2 of the first converter circuit 4 is kept constant.

At the time t1 of FIG. 13, when the user operates the setting unit 20 and the conduction angle of the setting signal V1 is rapidly decreased to 30 degrees from 150 degrees, a difference between the output voltage V4 of the smoothing circuit 8*a* and the output voltage V5 of the smoothing circuit 8*b* increases according to the difference in the time constant. In this case, if the first control circuit 9 increases the weighting of the output voltage V5 of the smoothing circuit 8*b* having the relatively large time constant and determines the command value V6 based thereon, the output powers of the second converter circuits 51*a* and 51*b* may be changed too late.

If the changes of the output powers of the second converter circuits 51*a* and 51*b* is delayed, the sum of the output powers of the second converter circuits 51*a* and 51*b* may exceed the maximum power (solid line L2 of FIG. 12) that can be supplied from the first converter circuit 4 (area W1 in FIG. 12). If a state where the output power of the first converter circuit 4 is insufficient continues, as shown by the dotted line in FIG. 13, the output voltage V2 of the first converter circuit 4 continues to decrease without maintaining a predetermined voltage value, and eventually may be lowered below the minimum operation voltage required for turning on the light source modules 6*a* and 6*b*.

In this embodiment, the first control circuit 9 compares the difference between the output voltage V4 and the output voltage V5 with the predetermined first threshold value, and if the difference between the output voltage V4 and the output voltage V5 is greater than the first threshold value, performs the weighting to increase the weight coefficient of the output voltage V4 of the smoothing circuit 8*a* having the relatively small time constant. Accordingly, the sum of the output powers of the second converter circuits 51*a* and 51*b* can converges in a short time to the sum of the output powers to be outputted when the conduction angle of the voltage signal V1 is 30 degrees.

Thus, it is possible to maintain a state where the sum of the output powers of the second converter circuits 51*a* and 51*b* is smaller than the maximum power that can be supplied from the first converter circuit 4, as the output voltage V2 of the first converter circuit 4 shown by the solid line in FIG. 13. Thus, even if the user operates the setting device 20 to vary the light output of the light source modules 6*a* and 6*b*, a lighting state (toned or dimmed state) set by the user can be obtained without flickering of the light output due to the insufficient output power of the first converter circuit 4.

As described above, in the lighting device 1A of the present embodiment, a plurality of smoothing units (smoothing circuits 8*a* and 8*b*) having different time constants may be provided. In this case, preferably, the control unit (first control circuit 9) weights the outputs of the smoothing units and controls the outputs of the voltage conversion units based on the command value determined from the weighted outputs of the smoothing units. The first control circuit 9 may perform the weighting on the output voltages V4 and V5 of the smoothing circuits 8*a* and 8*b* having different time constants.

Thus, the first control circuit 9 can control the light output to follow with good responsiveness the change in the setting signal by increasing the weighting of the smoothing circuit 8*a* having a relatively small time constant. Further, by increasing the weighting of the smoothing circuit 8*b* having a relatively large time constant, the first control circuit 9 can suppress the change in light output even when a distortion due to the noise or voltage variation is superimposed on the power supply voltage of the AC power source.

In the lighting device 1A of the present embodiment, in a state where the conduction angle is not changed by the setting unit 20, the first control circuit 9 may perform the weighting such that the output of the smoothing circuit 8*b* having a relatively large time constant is greater than that of the smoothing circuit 8*a* having a relatively small time constant. Further, in a state where the conduction angle is changed by the setting unit 20, the first control circuit 9 may perform the weighting such that the output of the smoothing circuit 8*a* having a relatively small time constant is greater than that of the smoothing circuit 8*b* having a relatively large time constant.

In the state where the conduction angle is not changed by the setting unit 20, since the weighting of the smoothing circuit 8*b* having a relatively large time constant is increased, it is possible to suppress the change in the light output even when the distortion due to the noise or voltage variation is superimposed on the power supply voltage of the AC power source. Further, in a state where the conduction angle is changed by the setting unit 20, since the weighting of the smoothing circuit 8*a* having a relatively small time constant is increased, it is possible to control the light output to follow with good responsiveness the change in the setting signal.

Figure 14:
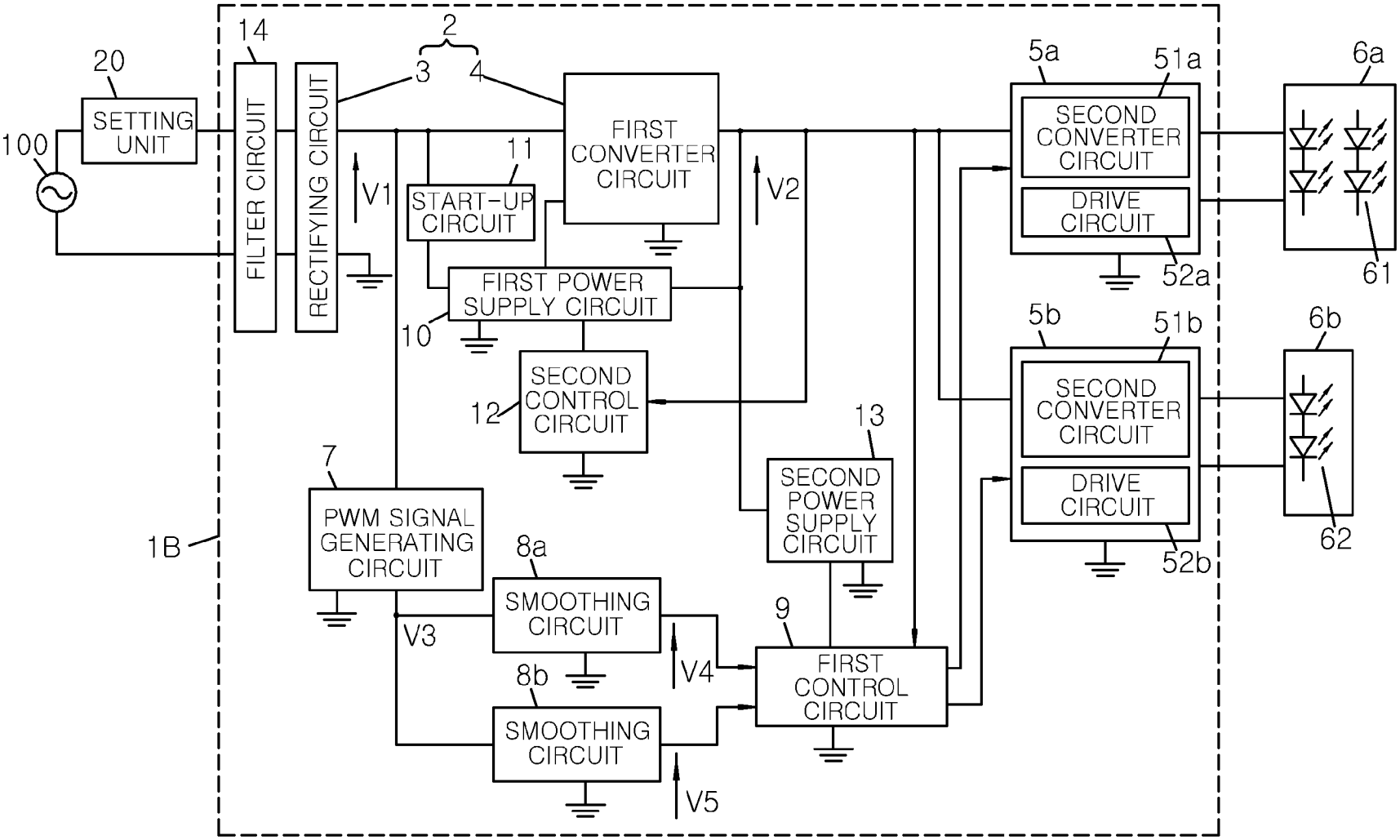
FIG. 14 is a schematic block circuit diagram showing another circuit configuration of the lighting device of the embodiment shown in FIG. 8.

Alternatively, as in a lighting device 1B shown in FIG. 14, the first control circuit 9 may perform the weighting on the outputs of the smoothing circuits 8*a* and 8*b* based on at least one of the comparison result of the difference between the outputs of the smoothing circuits 8*a* and 8*b* and the magnitude of the first threshold value and the comparison result of the output variation of the AC to DC conversion unit 2 and the magnitude of a second threshold value.

In this case, as shown in FIG. 14, the first control circuit 9 further includes an analog to digital conversion unit (not shown) to digitally convert the analogue output voltage V2 of the first converter circuit 4. Thus, if at least one of the condition that a difference between the output voltage V4 of the smoothing circuit 8*a* and the output voltage V5 of the smoothing circuit 8*b* is greater than the first threshold value, and the condition that a change in the output voltage V2 of the first converter circuit 4 is equal to or greater than the second threshold value is satisfied, the first control circuit 9 determines that the conduction angle has been varied by the setting unit 20.

Figure 15:
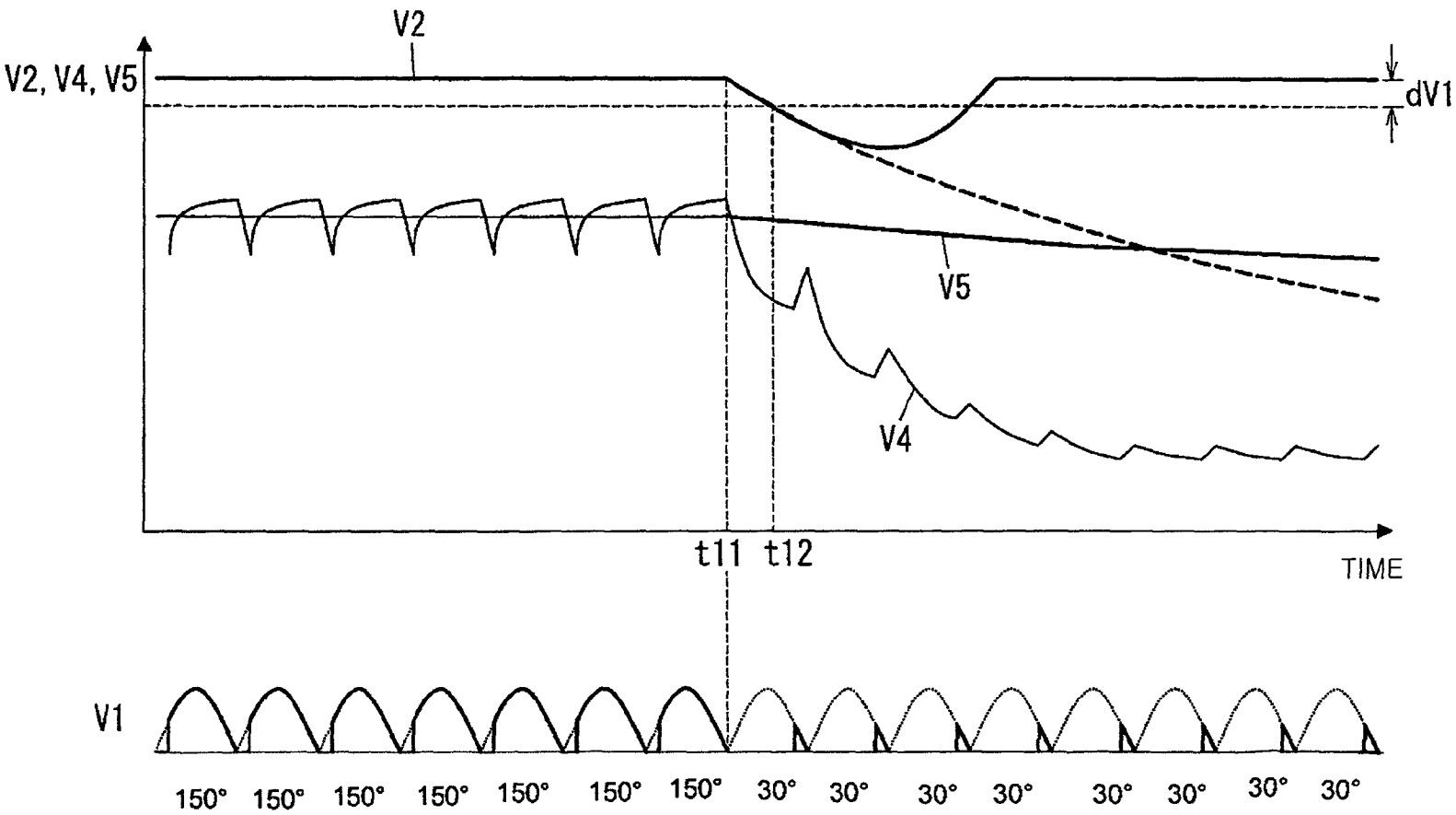
FIG. 15 is a diagram for explaining an operation of the lighting device shown in FIG. 14.

FIG. 15 is a waveform diagram for explaining an operation when the conduction angle is switched to 30 degrees from 150 degrees through the setting unit 20 at time t11.

Before time t11, the conduction angle of the setting signal inputted from the setting unit 20, i.e., the output signal V1 of the rectifying circuit 3, is set to 150 degrees. In this case, since the sum of the output powers of the second converter circuits 51*a* and 51*b* is less than the maximum power that can be supplied from the first converter circuit 4, the output voltage V2 of the first converter circuit 4 is maintained at a predetermined voltage value.

When the user operates the setting unit 20 to change the conduction angle of the voltage signal V1 from 150 degrees to 30 degrees at time t11, the output voltage V5 of the smoothing circuit 8*b* having a relatively large time constant decreases gradually, whereas the output voltage V4 of the smoothing circuit 8*a* having a relatively small time constant decreases rapidly. In this case, if the first control circuit 9 increases the weighting of the output voltage V5 of the smoothing circuit

8*b* having the relatively large time constant and performs the calculation of the command value V6 based thereon, the output power of the second converter circuits 51*a* and 51*b* is changed slowly.

Accordingly, there is a possibility that the sum of the output powers of the second converter circuits 51*a* and 51*b* exceeds the maximum power (solid line L2 of FIG. 12) that can be supplied from the first converter circuit 4 (area W1 in FIG. 12). In this case, as shown by the dotted line in FIG. 15, the output voltage V2 of the first converter circuit 4 decreases rapidly after time t11. Further, if a state where the output power of the first converter circuit 4 is insufficient continues, as shown by the dotted line in FIG. 15, the output voltage V2 continues to decrease, and eventually may be lowered below the minimum operation voltage required for turning on the light source modules 6*a* and 6*b*.

Therefore, based on at least one of the comparison result of the difference between the output voltage V4 and the output voltage V5 and the predetermined first threshold value and the comparison result of the change in the output voltage V2 and the second threshold value, the first control circuit 9 determines whether the conduction angle is changed by the setting unit 20 or not. If it is determined that the conduction angle is changed, the first control circuit 9 changes the weighting on the outputs of the smoothing circuits 8*a* and 8*b*. Specifically, the first control circuit 9 changes the weighting if at least one of the condition that a difference between the output voltage V4 and the output voltage V5 is greater than the first threshold value and the condition that a variation in the output voltage V2 of the first converter circuit 4 is equal to or greater than the second threshold value dV1 is satisfied.

In the example of FIG. 15, the variation of the output voltage V2 is equal to or greater than the second threshold value dV1 at time t12. The first control circuit 9 determines that the conduction angle is changed by the setting unit 20 when the variation of the output voltage V2 is equal to or greater than the second threshold value dV1. Accordingly, the first control circuit 9 performs the weighting to increase the weight coefficient of the output voltage V4 of the smoothing circuit 8*a* having a relatively small time constant, and controls the outputs of the second converter circuits 51*a* and 51*b* based on the command value V6 obtained from Eq. 1.

Thus, the sum of the output powers of the second converter circuits 51*a* and 51*b* converges in a short time to the sum of the output powers to be outputted when the conduction angle of the voltage signal V1 is 30 degrees. As a result, the sum of the output powers of the second converter circuits 51*a* and 51*b* becomes smaller than the maximum output of the first converter circuit 4. Further, the output voltage V2 of the first converter circuit 4 is temporary reduced, but is recovered thereafter to a predetermined voltage value as shown by the solid line in FIG. 15.

Thus, when the user operates the setting unit 20 to reduce the light color and the quantity of the output light, it is possible to maintain sufficiently the output power of the first converter circuit 4, thereby reducing the flickering of the output light.

As described above, in the lighting device 1B having a circuit configuration shown in FIG. 14, the first control circuit 9 (control unit) performs the weighting on the outputs of the smoothing circuits 8*a* and 8*b* based on at least one of the comparison result of the magnitude of the first threshold value with a difference between the outputs of the smoothing circuits 8*a* and 8*b* (second signal generating unit) and the comparison result of the magnitude of the second threshold value with an output variation of the AC to DC conversion unit 2. Specifically, if at least one of the condition that the difference between the outputs of the smoothing circuits 8*a* and 8*b* (second signal generating unit) is greater than the first threshold value, and the condition that the output variation of the AC to DC conversion unit 2 is equal to or greater than the second threshold value is satisfied, the first control circuit 9 determines that the conduction angle is varied by the setting unit 20, and performs the weighting on the outputs of the smoothing circuits 8*a* and 8*b*.

A reduction in the output voltage V2 of the first converter circuit 4 indicates that the sum of the output powers of the second converter circuits 51*a* and 51*b* exceeds the maximum power that can be supplied from the first converter circuit 4, and the conduction angle of the voltage signal V1 is reduced. In the present embodiment, since the first control circuit 9 increases the weighting of the smoothing circuit 8*a* having a relatively small time constant, the output powers of the second converter circuits 51*a* and 51*b* can converge in a short time to magnitudes corresponding to the conduction angle of the voltage signal V1. Therefore, the sum of the output powers of the second converter circuits 51*a* and 51*b* is suppressed to be equal to or less than the maximum power that can be supplied from the first converter circuit 4 and the output voltage V2 of the first converter circuit 4 is maintained at a predetermined voltage value.

Meanwhile, if the difference between the output voltages V4 and V5 of the smoothing circuits 8*a* and 8*b* is greater than the first threshold value even though there is little change in the output voltage V2 of the first converter circuit 4, it is considered that the output voltage V4 of the smoothing circuit 8*a* having a relatively small time constant is varied due to noise or the like. In this case, by increasing the weighting of the smoothing circuit 8*b* having a relatively large time constant, the first control circuit 9 can prevent the light output from being changed differently from the intention of the user.

Further, the illumination device according to the present embodiment includes one of the above-described lighting devices 1, 1A and 1B and a plurality of (e.g., two) light source modules 6*a* and 6*b*. The light source modules 6*a* and 6*b* have solid-state light emitting elements (light emitting diodes 61 and 62, respectively) having the different color temperatures between the light source modules. By adjusting the light outputs of the light source modules 6*a* and 6*b* different in color temperature from each other, it is possible to perform both toning and dimming.

Further, each of the light emitting diodes 61 and the light emitting diodes 62 may be configured to have only an LED chip such that light emitted from the LED chip is used directly, or to have an LED chip and a wavelength conversion member for wavelength-converting a part of the light emitted from the LED chip such that light obtained by mixing the wavelength converted light through a wavelength conversion member and the light emitted from the LED chip is used. In this case, the light emitting diodes 61 and the light emitting diodes 62 may use the same LED chips and different wavelength conversion members. By using the different wavelength conversion members, the light emitting diodes 61 may emit light having a color temperature different from that of the light emitting diodes 62.

In the illumination device of the present embodiment, the light source modules 6*a* and 6*b* may be configured to have the sum of forward voltages of the solid-state light emitting elements different from each other. By changing the light outputs of the light source modules 6*a* and 6*b* whose forward voltages are different, it is possible to perform the dimming control.

Further, in the above-described embodiments, the color temperatures of the light source modules 6*a* and 6*b* or the toning-dimming curve of the output light are merely exemplary. The color temperatures of the light source modules 6*a* and 6*b* or the toning-dimming curve of the output light may be modified appropriately without being limited thereto. With regard to the conduction angle of the setting signal inputted from the setting unit 20, the characteristic curve (see FIG. 12) of the power that can be supplied from the first converter circuit 4 is also exemplary and simplified, and is not limited to the characteristic curve of FIG. 12. The light source modules 6*a* and 6*b* include light emitting diodes as solid-state light emitting elements, but may include elements other than light emitting diodes, e.g., electroluminescence elements, as the solid-state light emitting elements.

Furthermore, in the above-described embodiments, although the lighting device 1 and the lighting devices 1A and 1B are described as independent examples, it goes without saying that combinations of the lighting device 1 and the lighting devices 1A and 1B may be employed.

Next, an example of an illumination apparatus 30, which includes the illumination device having one of the above-described lighting devices 1, 1A and 1B, will be described with reference to FIG. 16.

The illumination apparatus 30 of the present embodiment may be arranged to be embedded in, e.g., a ceiling member 40.

The illumination apparatus 30 includes the first case 31 accommodating the light source modules 6*a* and 6*b* and a second case 32 accommodating the components of the lighting device.

The first case 31 is formed of metal such as iron, aluminum and stainless steel in a cylindrical shape whose bottom surface is open. The first case 31 has an outer flange 33 formed to protrude outwardly in a radial direction at a lower end portion thereof. A mounting substrate 34 on which the light source modules 6*a* and 6*b* are mounted is attached to the inner upper surface (upper wall in FIG. 16) of the first case 31 such that the light source modules 6*a* and 6*b* face the opening side. The opening of the first case is closed by a light diffusing plate 35, and light emitted from the light source modules 6*a* and 6*b* passes through the light diffusing plate 35 and is irradiated to the outside. The light diffusing plate 35 has a function of diffusing light, and the light emitted from the light source modules 6*a* and 6*b* is diffused by the light diffusing plate 35 and is irradiated on a desired illumination area.

The first case 31 is inserted from below into a mounting hole 41 formed in the ceiling member 40, and is fixed to the ceiling member 40 in a state where the upper surface of the outer flange 33 is brought into contact with the periphery of the hole 41.

The second case 32 is formed of metal such as iron, aluminum and stainless steel in a box shape, and mounted above the ceiling member 40. Stands 36 are attached to both edges of a lower surface of the second case 32. In a state where the second case 32 is mounted on the upper surface of the ceiling member 40 through the stands 36, a gap is provided between the lower surface of the second case 32 and the upper surface of the ceiling member 40.

Wires 37 electrically connected to the light source modules 6*a* and 6*b* and extracted from the first case 31 are connected to a connector 37*a*. Further, wires 38 electrically connected to output terminals of the second converter circuits 51*a* and 51*b* and extracted from the second case 32 is connected to a connector 38*a*. When the connector 37*a* is connected to the connector 38*a*, the second converter circuit 51*a* is electrically connected to the light source module 6*a*, and the second converter circuit 51*b* is electrically connected to the light source module 6*b*.

The illumination apparatus 30 of the present embodiment includes one of the above-described lighting devices, to suppress an unintended change in the light output and improve the responsiveness of the output light.

The illumination system of the present embodiment includes one of the above-described lighting devices and the setting unit 20 which outputs to the lighting device the setting signal generated by adjusting the conduction angle of the AC voltage inputted from the AC power source 100. Since the illumination system includes one of the above-described lighting devices, it is possible to realize an illumination system capable of suppressing an unintended change in the light output, or improving the responsiveness of the output light.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting device for lighting a plurality of light source modules based on a conduction angle of a setting signal inputted from a setting unit, the setting unit outputting the setting signal generated by adjusting the conduction angle of an AC voltage inputted from an AC power source, each of the light source modules including solid-state light emitting elements, the lighting device comprising:

an AC to DC conversion unit configured to receive the setting signal and convert the setting signal into a DC voltage having a predetermined voltage value by rectifying and smoothing the setting signal;

voltage conversion units configured to convert a voltage level of the DC voltage inputted from the AC to DC conversion unit, and drive the light source modules according to drive signals;

a PWM signal generating unit configured to receive the setting signal, and generate a PWM signal having a duty ratio corresponding to a magnitude of the conduction angle of the setting signal; and a control unit configured to output the drive signals to the voltage conversion units based on a command value determined according to the duty ratio of the PWM signal, wherein the control unit controls output powers of the voltage conversion units such that a characteristic curve of the sum of the output powers of the voltage conversion units has the maximum or at least one inflection point between an upper limit and a lower limit of an adjustment range of the conduction angle.

2. A lighting device for lighting a plurality of light source modules based on a setting signal of a conduction angle inputted from a setting unit, the setting unit outputting the setting signal generated by adjusting the conduction angle of an AC voltage inputted from an AC power source, the lighting device comprising:

an AC to DC conversion unit configured to receive the setting signal and convert the setting signal into a DC voltage having a predetermined voltage value by rectifying and smoothing the setting signal;

voltage conversion units configured to convert a voltage level of the DC voltage outputted from the AC to DC conversion unit and drive the light source modules according to drive signals;

a PWM signal generating unit configured to receive the setting signal and generate a PWM signal having a duty ratio corresponding to a magnitude of the conduction angle of the setting signal; and a control unit configured to output the drive signals to the voltage conversion units based on a command value determined according to the duty ratio of the PWM signal, wherein the light source modules have solid-state light emitting elements different in emission color from each other, and include a first light source module having a relatively low color temperature and a second light source module having a relatively high color temperature, and wherein the control unit controls output powers of the voltage conversion units such that an output curve of a current flowing through the first light source module has the maximum or an inflection point, and a current flowing through the second light source module gradually increases as the conduction angle increases, between an upper limit and a lower limit of an adjustment range of the conduction angle.

3. The lighting device of claim 2, further comprising a smoothing unit configured to generate a DC voltage of a voltage value corresponding to the duty ratio of the PWM signal by smoothing the PWM signal, wherein the control unit is configured to determine the command value based on an output of the smoothing unit.

4. The lighting device of claim 3, wherein the smoothing unit includes a plurality of smoothing circuits having different time constants from each other, and wherein the control unit weights outputs of the smoothing circuits and determines the command value based on the weighted outputs of the smoothing circuits.

5. The lighting device of claim 4, wherein in a state where the conduction angle is not changed by the setting unit, the control unit is configured to set the weighting of the output of the smoothing circuit having a relatively large time constant to be greater than the weighting of the output of the smoothing circuit having a relatively small time constant, and wherein in a state where the conduction angle is changed by the setting unit, the control unit is configured to set the weighting of the output of the smoothing circuit having a relatively small time constant to be greater than the weighting of the output of the smoothing circuit having a relatively large time constant.

6. The lighting device of claim 4, wherein the control unit performs the weighting of the outputs of the smoothing circuits based on at least one of a comparison result of a difference between the outputs of the smoothing circuits and a first threshold value and a comparison result of an output variation of the AC to DC conversion unit and a second threshold value.

7. The lighting device of claim 5, wherein the control unit performs the weighting of the outputs of the smoothing circuits based on at least one of a comparison result of a difference between the outputs of the smoothing circuits and a first threshold value and a comparison result of an output variation of the AC to DC conversion unit and a second threshold value.

8. The lighting device of claim 1, wherein the control unit controls the output powers of the voltage conversion units to vary a color temperature of a mixed color light obtained by mixing output lights of the light source modules between a first color temperature less than a color temperature of bulb color and a second color temperature equal to or greater than a color temperature of daytime white according to the conduction angle such that the color temperature of the mixed color light is set to the first color temperature at the conduction angle at which the quantity of the mixed color light is minimized and the color temperature of the mixed color light is set to the second color temperature at the conduction angle at which the quantity of the mixed color light is maximized.

9. The lighting device of claim 2, wherein the control unit controls the output powers of the voltage conversion units to vary a color temperature of a mixed color light obtained by mixing output lights of the light source modules between a first color temperature less than a color temperature of bulb color and a second color temperature equal to or greater than a color temperature of daytime white according to the conduction angle such that the color temperature of the mixed color light is set to the first color temperature at the conduction angle at which the quantity of the mixed color light is minimized and the color temperature of the mixed color light is set to the second color temperature at the conduction angle at which the quantity of the mixed color light is maximized.

10. The lighting device of claim 1, wherein the control unit controls the output powers of the voltage conversion units such that a color of a mixed color light obtained by mixing output lights of the light source modules becomes bulb color at the conduction angle at which the characteristic curve of the sum of the output powers of the voltage conversion units has the maximum or an inflection point.

11. The lighting device of claim 2, wherein the control unit controls the output powers of the voltage conversion units such that a color of a mixed color light obtained by mixing output lights of the light source modules becomes bulb color at the conduction angle at which the characteristic curve of the sum of the output powers of the voltage conversion units has the maximum or an inflection point.

12. An illumination device comprising:

the lighting device described in claim 1; and an illumination load including the light source modules which are turned on and off by the lighting device.

13. An illumination device comprising:

the lighting device described in claim 2; and an illumination load including the light source modules which are turned on and off by the lighting device.

14. The illumination device of claim 13, wherein in the light source modules, the sums of forward voltages of the solid-state light emitting elements are different from each other.

15. The illumination device of claim 13, wherein the solid-state light emitting elements of the light source modules have a color temperature different between the light source modules.

16. An illumination apparatus comprising:

the illumination device described in claim 15; and an apparatus main body to which the illumination load is attached.

17. An illumination system comprising:

the illumination apparatus described in claim 16; and the setting unit including an operating unit, wherein the setting unit generates the setting signal by adjusting the conduction angle of the AC voltage inputted from the AC power source according to an operation of the operating unit and outputs the setting signal to the illumination apparatus.

18. The illumination system of claim 17, wherein the setting unit further includes a main body, wherein the operating unit is rotatably provided in the main body of the setting unit, and includes a mark indicating an operation position of the operating unit, and wherein in a state where the main body is attached to an wall, the control unit controls the output powers of the voltage conversion units such that the characteristic curve has the maximum or an inflection point when the operating unit is rotated to the operation position in which the mark is oriented toward an upper side.

19. The illumination system of claim 17, wherein the setting unit further includes a main body, wherein the operating unit is slidably provided in the main body of the setting unit, and includes a mark indicating an operation position of the operating unit, and wherein the control unit controls the output powers of the voltage conversion units such that the characteristic curve has the maximum or an inflection point when the operating unit is operated such that the mark is positioned at the center of an adjustment range of the operating unit.

20. The illumination system of claim 17, wherein the setting unit further includes a main body, wherein the operating unit includes a first button for increasing the conduction angle, a second button for decreasing the conduction angle and a display unit to display a level at which the conduction angle is set, the first and the second button being provided in the main body of the setting unit, and wherein the control unit controls the output powers of the voltage conversion units such that the characteristic curve has the maximum or an inflection point when the operating unit is operated such that a display position of the display unit is positioned at a center of a display range of the display unit.

* * * * *